US006476781B1

(12) United States Patent
Suzuki et al.

(10) Patent No.: US 6,476,781 B1
(45) Date of Patent: Nov. 5, 2002

(54) METHOD FOR DRIVING A DISPLAY PANEL

(75) Inventors: Masahiro Suzuki, Yamanashi (JP); Nobuhiko Saegusa, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/516,513

(22) Filed: Mar. 1, 2000

(30) Foreign Application Priority Data

Mar. 4, 1999 (JP) ..... 11-057687

(51) Int. Cl.[7] ..... G09G 3/28; G09G 3/36
(52) U.S. Cl. ..... 345/60; 345/89
(58) Field of Search ..... 345/596, 600, 345/605, 690, 691, 692, 693, 60, 63, 64, 77, 87, 89

(56) References Cited

U.S. PATENT DOCUMENTS 6,064,359 A * 5/2000 Lin et al. ..... 345/692
6,320,560 B1 * 11/2001 Sasaki et al. ..... 315/169.1

* cited by examiner

*Primary Examiner*—Vijay Shankar
(74) *Attorney, Agent, or Firm*—Sughrue Mion, PLLC

(57) ABSTRACT

Disclosed herein is a method for driving display panels which provides excellent image display suitable for human visual characteristics. The method makes the number of levels of gray scale drive assigned to display images with low brightness greater than that assigned to display images with high brightness in order to drive the display panel with the number of levels of gray scale drive less than the levels of brightness that can be expressed by the pixel data corresponding to an input video signal.

17 Claims, 26 Drawing Sheets

FIG. 5

[SELECTIVE ERASE]

| Ds | HD | | | | | | | |
|---|---|---|---|---|---|---|---|---|
| | 1 | 2 | 3 | 4 | 5 | 6 | 7 | 8 |
| 0000 | 1 | 1 | 1 | 1 | 1 | 1 | 1 | 1 |
| 0001 | 0 | 1 | 1 | 1 | 1 | 1 | 1 | 1 |
| 0010 | 1 | 0 | 1 | 1 | 1 | 1 | 1 | 1 |
| 0011 | 0 | 0 | 1 | 1 | 1 | 1 | 1 | 1 |
| 0100 | 1 | 1 | 0 | 1 | 1 | 1 | 1 | 1 |
| 0101 | 0 | 1 | 0 | 1 | 1 | 1 | 1 | 1 |
| 0110 | 0 | 0 | 0 | 1 | 1 | 1 | 1 | 1 |
| 0111 | 0 | 0 | 1 | 0 | 1 | 1 | 1 | 1 |
| 1000 | 1 | 0 | 1 | 1 | 0 | 1 | 1 | 1 |
| 1001 | 0 | 0 | 1 | 0 | 0 | 1 | 1 | 1 |
| 1010 | 0 | 0 | 1 | 0 | 1 | 0 | 1 | 1 |
| 1011 | 0 | 0 | 1 | 1 | 1 | 1 | 0 | 1 |
| 1100 | 0 | 1 | 1 | 0 | 1 | 0 | 0 | 1 |
| 1101 | 1 | 1 | 0 | 1 | 1 | 0 | 1 | 0 |
| 1110 | 0 | 0 | 0 | 0 | 0 | 0 | 0 | 0 |

FIG. 8

GRAY SCALE DRIVE

DIFFERENCE IN BRIGHTNESS BETWEEN LEVELS OF GRAY SCALE

DISPLAY BRIGHTNESS

| | D [DECIMAL] | DP [DECIMAL] | DS | HD 1 | HD 2 | HD 3 | HD 4 | HD 5 | HD 6 | HD 7 | HD 8 | ONE FIELD LIGHT EMISSION DRIVE PATTERN SF 1 | SF 2 | SF 3 | SF 4 | SF 5 | SF 6 | SF 7 | SF 8 | | |
|---|---|---|---|---|---|---|---|---|---|---|---|---|---|---|---|---|---|---|---|---|---|
| 1 | 0~17 | 0~15 | 0000 | 1 | 1 | 1 | 1 | 1 | 1 | 1 | 1 | | | | | | | | | 0 | |
| 2 | 18~22 | 16~31 | 0001 | 0 | 1 | 1 | 1 | 1 | 1 | 1 | 1 | ○ | | | | | | | | 1 | 1 |
| 3 | 23~26 | 32~47 | 0010 | 1 | 0 | 1 | 1 | 1 | 1 | 1 | 1 | | ○ | | | | | | | 2 | 1 |
| 4 | 27~33 | 48~63 | 0011 | 0 | 0 | 1 | 1 | 1 | 1 | 1 | 1 | ○ | ○ | | | | | | | 3 | 1 |
| 5 | 34~40 | 64~79 | 0100 | 1 | 1 | 0 | 1 | 1 | 1 | 1 | 1 | | | ○ | | | | | | 4 | 1 |
| 6 | 41~49 | 80~95 | 0101 | 0 | 1 | 0 | 1 | 1 | 1 | 1 | 1 | ○ | | ○ | | | | | | 5 | 2 |
| 7 | 50~61 | 96~111 | 0110 | 0 | 0 | 0 | 1 | 1 | 1 | 1 | 1 | ○ | ○ | ○ | | | | | | 7 | 4 |
| 8 | 62~74 | 112~127 | 0111 | 0 | 0 | 1 | 0 | 1 | 1 | 1 | 1 | ○ | ○ | | ○ | | | | | 11 | 7 |
| 9 | 75~91 | 128~143 | 1000 | 1 | 0 | 1 | 1 | 0 | 1 | 1 | 1 | | ○ | | | ○ | | | | 18 | 9 |
| 10 | 92~112 | 144~159 | 1001 | 0 | 0 | 1 | 0 | 0 | 1 | 1 | 1 | ○ | ○ | | ○ | ○ | | | | 27 | 16 |
| 11 | 113~138 | 160~175 | 1010 | 0 | 0 | 1 | 0 | 1 | 0 | 1 | 1 | ○ | ○ | | ○ | | ○ | | | 43 | 24 |
| 12 | 139~169 | 176~191 | 1011 | 0 | 0 | 1 | 1 | 1 | 1 | 0 | 1 | ○ | ○ | | | | | ○ | | 67 | 38 |
| 13 | 170~207 | 192~207 | 1100 | 0 | 1 | 1 | 0 | 1 | 0 | 0 | 1 | ○ | | | ○ | | ○ | ○ | | 105 | 59 |
| 14 | 208~254 | 208~223 | 1101 | 1 | 1 | 0 | 1 | 1 | 0 | 1 | 0 | | | ○ | | | ○ | | ○ | 164 | 91 |
| 15 | 255 | 224 | 1110 | 0 | 0 | 0 | 0 | 0 | 0 | 0 | 0 | ○ | ○ | ○ | ○ | ○ | ○ | ○ | ○ | 256 | |

○: LIGHT EMISSION BY SUSTAIN DISCHARGE

FIG.13

GRAY SCALE DRIVE

DIFFERENCE IN BRIGHTNESS BETWEEN LEVELS OF GRAY SCALE

DISPLAY BRIGHTNESS

| | D [DECIMAL] | $D_P$ [DECIMAL] | $D_S$ | HD (1 — 14) | ONE FIELD LIGHT EMISSION DRIVE PATTERN (SF 1 SF 2 SF 3 SF 4 SF 5 SF 6 SF 7 SF 8 SF 9 SF 10 SF 11 SF 12 SF 13 SF 14) | | |
|---|---|---|---|---|---|---|---|
| 1 | 0~17 | 0~15 | 0000 | 1 0 0 0 0 0 0 0 0 0 0 0 0 0 | ● | 0 | |
| 2 | 18~22 | 16~31 | 0001 | 0 1 0 0 0 0 0 0 0 0 0 0 0 0 | ○● | 1 | 1 |
| 3 | 23~26 | 32~47 | 0010 | 0 0 1 0 0 0 0 0 0 0 0 0 0 0 | ○○● | 2 | 1 |
| 4 | 27~33 | 48~63 | 0011 | 0 0 0 1 0 0 0 0 0 0 0 0 0 0 | ○○○● | 3 | 1 |
| 5 | 34~40 | 64~79 | 0100 | 0 0 0 0 1 0 0 0 0 0 0 0 0 0 | ○○○○● | 4 | 1 |
| 6 | 41~49 | 80~95 | 0101 | 0 0 0 0 0 1 0 0 0 0 0 0 0 0 | ○○○○○● | 6 | 2 |
| 7 | 50~61 | 96~111 | 0110 | 0 0 0 0 0 0 1 0 0 0 0 0 0 0 | ○○○○○○● | 9 | 3 |
| 8 | 62~74 | 112~127 | 0111 | 0 0 0 0 0 0 0 1 0 0 0 0 0 0 | ○○○○○○○● | 13 | 4 |
| 9 | 75~91 | 128~143 | 1000 | 0 0 0 0 0 0 0 0 1 0 0 0 0 0 | ○○○○○○○○● | 19 | 6 |
| 10 | 92~112 | 144~159 | 1001 | 0 0 0 0 0 0 0 0 0 1 0 0 0 0 | ○○○○○○○○○● | 29 | 10 |
| 11 | 113~138 | 160~175 | 1010 | 0 0 0 0 0 0 0 0 0 0 1 0 0 0 | ○○○○○○○○○○● | 44 | 15 |
| 12 | 139~169 | 176~191 | 1011 | 0 0 0 0 0 0 0 0 0 0 0 1 0 0 | ○○○○○○○○○○○● | 68 | 24 |
| 13 | 170~207 | 192~207 | 1100 | 0 0 0 0 0 0 0 0 0 0 0 0 1 0 | ○○○○○○○○○○○○● | 106 | 38 |
| 14 | 208~254 | 208~223 | 1101 | 0 0 0 0 0 0 0 0 0 0 0 0 0 1 | ○○○○○○○○○○○○○● | 165 | 59 |
| 15 | 255 | 224 | 1110 | 0 0 0 0 0 0 0 0 0 0 0 0 0 0 | ○○○○○○○○○○○○○○ | 256 | 91 |

●: SELECTIVE ERASE DISCHARGE

○: LIGHT EMISSION BY SUSTAIN DISCHARGE

FIG.16

GRAY SCALE DRIVE

DIFFERENCE IN BRIGHTNESS BETWEEN LEVELS OF GRAY SCALE

DISPLAY BRIGHTNESS

| | D [DECIMAL] | DP [DECIMAL] | DS | HD 1 — 14 | ONE FIELD LIGHT EMISSION DRIVE PATTERN SF 1 | SF 2 | SF 3 | SF 4 | SF 5 | SF 6 | SF 7 | SF 8 | SF 9 | SF 10 | SF 11 | SF 12 | SF 13 | SF 14 | | |
|---|---|---|---|---|---|---|---|---|---|---|---|---|---|---|---|---|---|---|---|---|
| 1 | 0~17 | 0~15 | 0000 | 1 1 * * * * * * * * * * * * | ● | ● | △ | △ | △ | △ | △ | △ | △ | △ | △ | △ | △ | △ | 0 | |
| 2 | 18~22 | 16~31 | 0001 | 0 1 1 * * * * * * * * * * * | ○ | ● | ● | △ | △ | △ | △ | △ | △ | △ | △ | △ | △ | △ | 1 | 1 |
| 3 | 23~26 | 32~47 | 0010 | 0 0 1 1 * * * * * * * * * * | ○ | ○ | ● | ● | △ | △ | △ | △ | △ | △ | △ | △ | △ | △ | 2 | 1 |
| 4 | 27~33 | 48~63 | 0011 | 0 0 0 1 1 * * * * * * * * * | ○ | ○ | ○ | ● | ● | △ | △ | △ | △ | △ | △ | △ | △ | △ | 3 | 1 |
| 5 | 34~40 | 64~79 | 0100 | 0 0 0 0 1 1 * * * * * * * * | ○ | ○ | ○ | ○ | ● | ● | △ | △ | △ | △ | △ | △ | △ | △ | 4 | 2 |
| 6 | 41~49 | 80~95 | 0101 | 0 0 0 0 0 1 1 * * * * * * * | ○ | ○ | ○ | ○ | ○ | ● | ● | △ | △ | △ | △ | △ | △ | △ | 6 | 3 |
| 7 | 50~61 | 96~111 | 0110 | 0 0 0 0 0 0 1 1 * * * * * * | ○ | ○ | ○ | ○ | ○ | ○ | ● | ● | △ | △ | △ | △ | △ | △ | 9 | 4 |
| 8 | 62~74 | 112~127 | 0111 | 0 0 0 0 0 0 0 1 1 * * * * * | ○ | ○ | ○ | ○ | ○ | ○ | ○ | ● | ● | △ | △ | △ | △ | △ | 13 | 6 |
| 9 | 75~91 | 128~143 | 1000 | 0 0 0 0 0 0 0 0 1 1 * * * * | ○ | ○ | ○ | ○ | ○ | ○ | ○ | ○ | ● | ● | △ | △ | △ | △ | 19 | 10 |
| 10 | 92~112 | 144~159 | 1001 | 0 0 0 0 0 0 0 0 0 1 1 * * * | ○ | ○ | ○ | ○ | ○ | ○ | ○ | ○ | ○ | ● | ● | △ | △ | △ | 29 | 15 |
| 11 | 113~138 | 160~175 | 1010 | 0 0 0 0 0 0 0 0 0 0 1 1 * * | ○ | ○ | ○ | ○ | ○ | ○ | ○ | ○ | ○ | ○ | ● | ● | △ | △ | 44 | 24 |
| 12 | 139~169 | 176~191 | 1011 | 0 0 0 0 0 0 0 0 0 0 0 1 1 * | ○ | ○ | ○ | ○ | ○ | ○ | ○ | ○ | ○ | ○ | ○ | ● | ● | △ | 68 | 38 |
| 13 | 170~207 | 192~207 | 1100 | 0 0 0 0 0 0 0 0 0 0 0 0 1 1 | ○ | ○ | ○ | ○ | ○ | ○ | ○ | ○ | ○ | ○ | ○ | ○ | ● | ● | 106 | 59 |
| 14 | 208~254 | 208~223 | 1101 | 0 0 0 0 0 0 0 0 0 0 0 0 0 1 | ○ | ○ | ○ | ○ | ○ | ○ | ○ | ○ | ○ | ○ | ○ | ○ | ○ | ● | 165 | 91 |
| 15 | 255 | 224 | 1110 | 0 0 0 0 0 0 0 0 0 0 0 0 0 0 | ○ | ○ | ○ | ○ | ○ | ○ | ○ | ○ | ○ | ○ | ○ | ○ | ○ | ○ | 256 | |

●: SELECTIVE ERASE DISCHARGE

○: LIGHT EMISSION BY SUSTAIN DISCHARGE

FIG.19

GRAY SCALE DRIVE

DIFFERENCE IN BRIGHTNESS BETWEEN LEVELS OF GRAY SCALE

DISPLAY BRIGHTNESS

| | D [DECIMAL] | $D_P$ [DECIMAL] | $D_S$ | HD 1 — 14 | ONE FIELD LIGHT EMISSION DRIVE PATTERN SF 1 | SF 2 | SF 3 | SF 4 | SF 5 | SF 6 | SF 7 | SF 8 | SF 9 | SF 10 | SF 11 | SF 12 | SF 13 | SF 14 | | |
|---|---|---|---|---|---|---|---|---|---|---|---|---|---|---|---|---|---|---|---|---|
| 1 | 0~10 | 0~15 | 0000 | 1 0 0 0 0 0 0 0 0 0 0 0 0 0 | ● | | | | | | | | | | | | | | 0 | |
| 2 | 11~18 | 16~31 | 0001 | 0 1 0 0 0 0 0 0 0 0 0 0 0 0 | ○ | ● | | | | | | | | | | | | | 1 | 1 |
| 3 | 19~26 | 32~47 | 0010 | 0 0 1 0 0 0 0 0 0 0 0 0 0 0 | ○ | ○ | ● | | | | | | | | | | | | 2 | 1 |
| 4 | 27~42 | 48~63 | 0011 | 0 0 0 1 0 0 0 0 0 0 0 0 0 0 | ○ | ○ | ○ | ● | | | | | | | | | | | 3 | 3 |
| 5 | 43~59 | 64~79 | 0100 | 0 0 0 0 1 0 0 0 0 0 0 0 0 0 | ○ | ○ | ○ | ○ | ● | | | | | | | | | | 6 | 5 |
| 6 | 60~77 | 80~95 | 0101 | 0 0 0 0 0 1 0 0 0 0 0 0 0 0 | ○ | ○ | ○ | ○ | ○ | ● | | | | | | | | | 11 | 8 |
| 7 | 78~96 | 96~111 | 0110 | 0 0 0 0 0 0 1 0 0 0 0 0 0 0 | ○ | ○ | ○ | ○ | ○ | ○ | ● | | | | | | | | 19 | 11 |
| 8 | 97~115 | 112~127 | 0111 | 0 0 0 0 0 0 0 1 0 0 0 0 0 0 | ○ | ○ | ○ | ○ | ○ | ○ | ○ | ● | | | | | | | 30 | 16 |
| 9 | 116~136 | 128~143 | 1000 | 0 0 0 0 0 0 0 0 1 0 0 0 0 0 | ○ | ○ | ○ | ○ | ○ | ○ | ○ | ○ | ● | | | | | | 46 | 20 |
| 10 | 137~158 | 144~159 | 1001 | 0 0 0 0 0 0 0 0 0 1 0 0 0 0 | ○ | ○ | ○ | ○ | ○ | ○ | ○ | ○ | ○ | ● | | | | | 66 | 25 |
| 11 | 159~181 | 160~175 | 1010 | 0 0 0 0 0 0 0 0 0 0 1 0 0 0 | ○ | ○ | ○ | ○ | ○ | ○ | ○ | ○ | ○ | ○ | ● | | | | 91 | 31 |
| 12 | 182~204 | 176~191 | 1011 | 0 0 0 0 0 0 0 0 0 0 0 1 0 0 | ○ | ○ | ○ | ○ | ○ | ○ | ○ | ○ | ○ | ○ | ○ | ● | | | 122 | 37 |
| 13 | 205~229 | 192~207 | 1100 | 0 0 0 0 0 0 0 0 0 0 0 0 1 0 | ○ | ○ | ○ | ○ | ○ | ○ | ○ | ○ | ○ | ○ | ○ | ○ | ● | | 159 | 45 |
| 14 | 230~254 | 208~223 | 1101 | 0 0 0 0 0 0 0 0 0 0 0 0 0 1 | ○ | ○ | ○ | ○ | ○ | ○ | ○ | ○ | ○ | ○ | ○ | ○ | ○ | ● | 204 | 52 |
| 15 | 255 | 224 | 1110 | 0 0 0 0 0 0 0 0 0 0 0 0 0 0 | ○ | ○ | ○ | ○ | ○ | ○ | ○ | ○ | ○ | ○ | ○ | ○ | ○ | ○ | 256 | |

●: SELECTIVE ERASE DISCHARGE

○: LIGHT EMISSION BY SUSTAIN DISCHARGE

FIG.26

GRAY SCALE DRIVE

DISPLAY BRIGHTNESS

DIFFERENCE IN BRIGHTNESS BETWEEN LEVELS OF GRAY SCALE

| | D [DECIMAL] | Dp [DECIMAL] | Ds | HD (1 — 14) | ONE FIELD LIGHT EMISSION DRIVE PATTERN (SF 1 SF 2 SF 3 SF 4 SF 5 SF 6 SF 7 SF 8 SF 9 SF 10 SF 11 SF 12 SF 13 SF 14) | | |
|---|---|---|---|---|---|---|---|
| 1 | 0~17 | 0~15 | 0000 | 0 0 0 0 0 0 0 0 0 0 0 0 0 0 | | 0 | |
| 2 | 18~22 | 16~31 | 0001 | 0 0 0 0 0 0 0 0 0 0 0 0 0 1 | ● | 1 | 1 |
| 3 | 23~26 | 32~47 | 0010 | 0 0 0 0 0 0 0 0 0 0 0 0 1 0 | ● ○ | 2 | 1 |
| 4 | 27~33 | 48~63 | 0011 | 0 0 0 0 0 0 0 0 0 0 0 1 0 0 | ● ○ ○ | 3 | 1 |
| 5 | 34~40 | 64~79 | 0100 | 0 0 0 0 0 0 0 0 0 0 1 0 0 0 | ● ○ ○ ○ | 4 | 1 |
| 6 | 41~49 | 80~95 | 0101 | 0 0 0 0 0 0 0 0 0 1 0 0 0 0 | ● ○ ○ ○ ○ | 6 | 2 |
| 7 | 50~61 | 96~111 | 0110 | 0 0 0 0 0 0 0 0 1 0 0 0 0 0 | ● ○ ○ ○ ○ ○ | 9 | 3 |
| 8 | 62~74 | 112~127 | 0111 | 0 0 0 0 0 0 0 1 0 0 0 0 0 0 | ● ○ ○ ○ ○ ○ ○ | 13 | 4 |
| 9 | 75~91 | 128~143 | 1000 | 0 0 0 0 0 0 1 0 0 0 0 0 0 0 | ● ○ ○ ○ ○ ○ ○ ○ | 19 | 6 |
| 10 | 92~112 | 144~159 | 1001 | 0 0 0 0 0 1 0 0 0 0 0 0 0 0 | ● ○ ○ ○ ○ ○ ○ ○ ○ | 29 | 10 |
| 11 | 113~138 | 160~175 | 1010 | 0 0 0 0 1 0 0 0 0 0 0 0 0 0 | ● ○ ○ ○ ○ ○ ○ ○ ○ ○ | 44 | 15 |
| 12 | 139~169 | 176~191 | 1011 | 0 0 0 1 0 0 0 0 0 0 0 0 0 0 | ● ○ ○ ○ ○ ○ ○ ○ ○ ○ ○ | 68 | 24 |
| 13 | 170~207 | 192~207 | 1100 | 0 0 1 0 0 0 0 0 0 0 0 0 0 0 | ● ○ ○ ○ ○ ○ ○ ○ ○ ○ ○ ○ | 106 | 38 |
| 14 | 208~254 | 208~223 | 1101 | 0 1 0 0 0 0 0 0 0 0 0 0 0 0 | ● ○ ○ ○ ○ ○ ○ ○ ○ ○ ○ ○ ○ | 165 | 59 |
| 15 | 255 | 224 | 1110 | 1 0 0 0 0 0 0 0 0 0 0 0 0 0 | ● ○ ○ ○ ○ ○ ○ ○ ○ ○ ○ ○ ○ ○ | 256 | 91 |

●: SELECTIVE WRITE DISCHARGE

○: LIGHT EMISSION BY SUSTAIN DISCHARGE

METHOD FOR DRIVING A DISPLAY PANEL

BACKGROUND OF THE INVENTION

1. Field of the Invention

The present invention relates to a method for driving a display panel.

2. Description of Related Art

Recently, as thin flat display panels, for example, plasma display panels (hereinafter called "PDP") and electroluminescent display panels (hereinafter called "ELDP") have been placed on the market. The light-emitting elements of these PDP and ELDP having only two states, "light-emitting" and "non-light-emitting", whereby halftone drive is effectuated using a sub-field method in order to obtain halftone brightness corresponding to input video signals.

By the sub-field method, an input video signal is converted into N-bit pixel data for each pixel and the display period of one field is divided into N sub-fields corresponding to each of the N-bit bit digits. Each sub-field is assigned a frequency of light emissions corresponding to each of the bit digits of the aforementioned pixel data, respectively. In cases where one bit digit of the aforementioned N bits has, for example, a logic level of "1", light emission is executed for the frequency assigned as mentioned above in the sub-field corresponding to the bit digit. On the other hand, in cases where the aforementioned one bit digit has a logic level "0", no light emission is effected in the sub-field corresponding to the bit digit. According to such a drive method, levels of halftone brightness corresponding to input video signals are expressed by the sum of the frequency of light emissions executed in all sub-fields within the display period of one field.

OBJECT AND SUMMARY OF THE INVENTION

An object of the present invention is to provide a drive method which can provide an excellent expression a of gray scale in response to the human visual property on a display panel for expressing gray scale using the aforementioned subfield method.

The method for driving a display panel, according to the present invention, is to drive a display panel which forms pixel cells at respective intersections of a plurality of electrode rows and a plurality of electrode columns arranged to intersect said electrode rows; when performing a gray scale drive of said display panel by assigning each of gray scale drive processes of N levels of gray scale that are different from one another in the frequency of light emissions to be executed in one field period to input pixel data based on the brightness of said input pixel data available for expressing the brightness of M levels of a gray scale (M>N), the number of said halftone drive processes assigned to low brightness data of said input pixel data is made larger than the number of said halftone drive processes assigned to high brightness data of said input pixel data.

BRIEF DESCRIPTION OF THE DRAWINGS

FIG. 5 is a view showing a conversion table of a drive data generating circuit 35.

FIG. 8 is a view showing the correspondence among the first through $15^{th}$ levels of halftone drive to be performed in the plasma display device shown in FIG. 1, pixel data D, Dp, multi-level gray scale pixel data Ds, drive pixel data HD, and light emission drive patterns.

FIG. 13 is a view showing the correspondence among the first through $15^{th}$ levels of halftone drive to be performed in the plasma display device shown in FIG. 10, pixel data D, Dp, multi-level gray scale pixel data Ds, drive pixel data HD, and light emission drive patterns.

FIG. 16 is a view showing the correspondence among the first through $15^{th}$ levels of halftone drive to be performed in the plasma display device shown in FIG. 10, pixel data D, Dp, multi-level gray scale pixel data Ds, drive pixel data HD, and light emission drive patterns.

FIG. 19 is a view showing the correspondence among the first through $15^{th}$ levels of halftone drive to be performed when light emission drive is performed in accordance with the light emission drive format shown in FIG. 17, pixel data D, Dp, multi-level gray scale pixel data Ds, drive pixel data HD, and light emission drive patterns.

FIG. 26 is a view showing the correspondence among the first through $15^{th}$ levels of halftone drive to be performed when the selective write address method is employed, pixel data D, Dp, multi-level gray scale pixel data Ds, drive pixel data HD, and light emission drive patterns.

DETAILED DESCRIPTION OF THE PREFERRED EMBODIMENTS

The embodiments of the present invention will be explained below with reference to the drawings.

Figure 1:
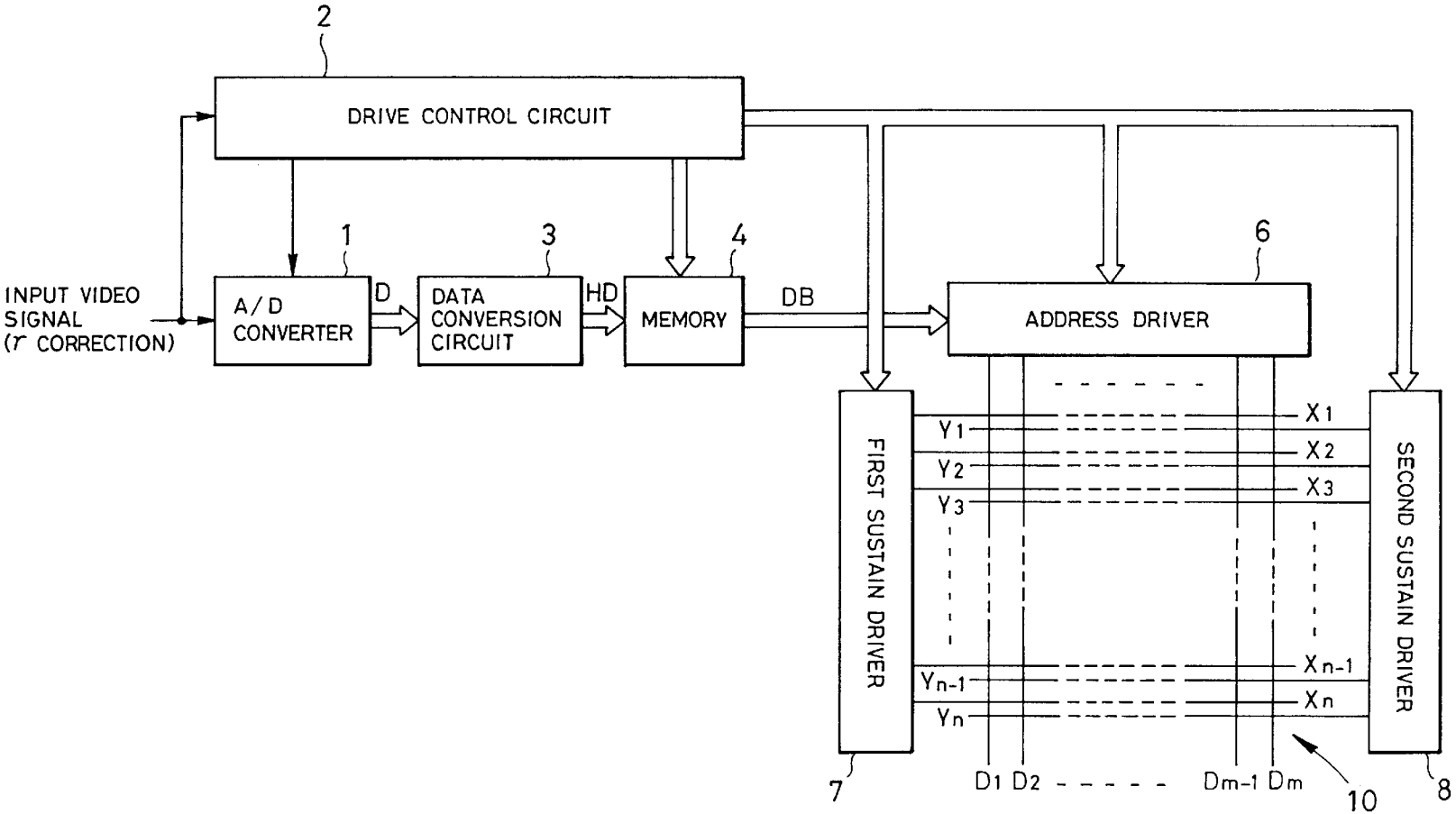
FIG. 1 is a schematic view showing the configuration of a plasma display device for performing light emission drive of a plasma display panel in accordance with the drive method according to the present invention.

FIG. 1 is a schematic view showing the configuration of a plasma display device for performing light emission drive of a plasma display panel in accordance with the drive method according to the present invention.

As shown in FIG. 1, such a plasma display device comprises a PDP 10 as a plasma display panel, an A/D converter 1, a drive control circuit 2, a data conversion circuit 3, a memory 4, an address driver 6, and a drive portion comprising a first and second sustain drivers 7, 8.

The PDP 10 comprises m electrode columns $D_1$ to $D_m$ serving as address electrodes, and n electrode rows $X_1$ to $X_n$ and n electrode rows $Y_1$ to $Y_n$, which are arranged to intersect these electrode columns, respectively. A pair of a electrode row X and a electrode row Y forms a electrode row corresponding to one line of the PDP 10. The electrode columns D and electrode rows X, Y are coated with a dielectric layer exposed to a discharge space, and a discharge cell corresponding to one pixel is so configured as to be formed at an intersection of each pair of electrode rows and a electrode column.

The A/D converter 1 performs sampling by correlating an input analog video signal with one pixel of the PDP 10, and determines 8-bit pixel data D available for expressing the brightness of 256 levels of halftone which is in turn supplied to the data conversion circuit 3. Moreover, this input video signal has been obtained by applying the Gamma correction to an original video signal in accordance with the Gamma correction curveƒÁshown in FIG. 2.

Figure 3:
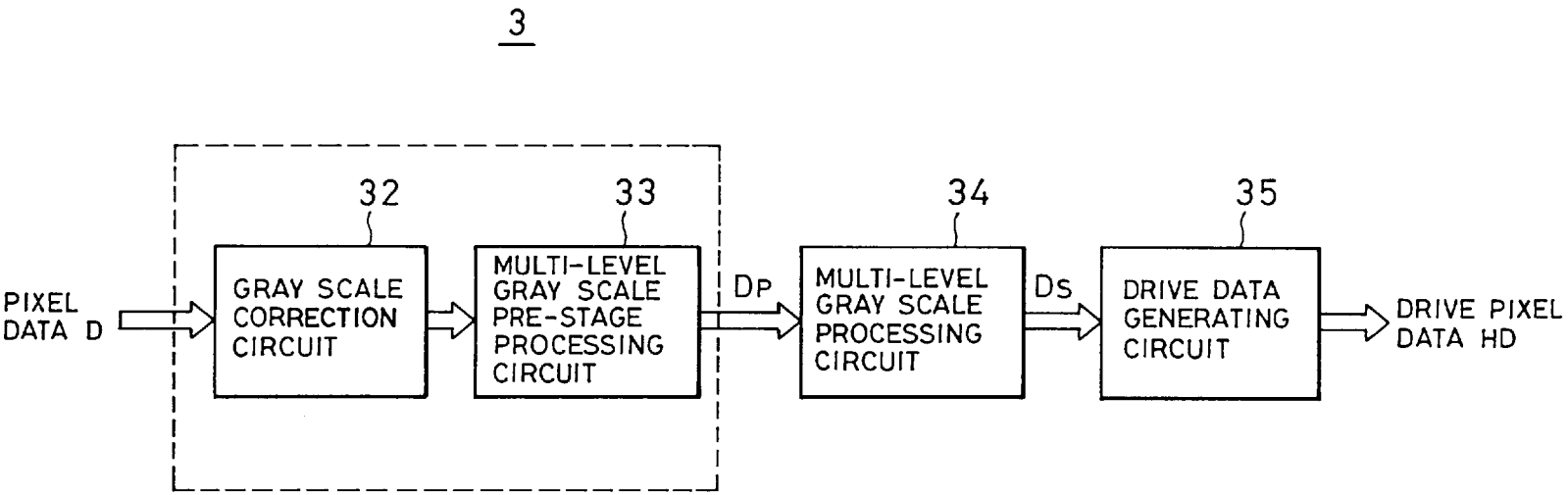
FIG. 3 is a view showing the internal configuration of a data conversion circuit 3.

FIG. 3 shows the internal configuration of the data conversion circuit 3.

In FIG. 3, a gray scale correction circuit 32 applies data conversion to the aforementioned pixel data D such that halftone drive can be effectuated so as to obtain display brightness that matches the human's visual property. Then, the gray scale correction circuit 32 supplies the resultant data to a multi-level gray scale pre-stage processing circuit 33. Moreover, the action provided by means of the gray scale correction circuit 32 will be described later. The multi-level gray scale pre-stage processing circuit 33 multiplies the pixel data, which is available for expressing 8-bit 256 (0 to 255) levels of halftone and provided with halftone correction by means of the gray scale correction circuit 32, by (224/225), thereby converting the pixel data into 8-bit pixel data Dp of 225 levels of halftone which is in turn supplied to a multi-level gray scale processing circuit 34. Moreover, this conversion characteristic is set in response to the number of bits of the pixel data D, the number of bits of input pixel data, the number of compression bits provided by a multi-level gray scale processing to be described later, and the number of display levels of halftone. As such, the multi-level gray scale pre-stage processing circuit 33 is provided at the preceding stage of the multi-level gray scale processing circuit 34, which is described later, to effectuate data conversion in response to the number of display levels of halftone and the number of compression bits provided by multi-level gray scale processing, thereby preventing the occurrence of brightness saturation caused by the multi-level gray scale processing and the occurrence of flat portions in display characteristics (that is, the occurrence of gray scale distortion) produced in cases where a display level of halftone is not available at a bit boundary.

Figure 4:
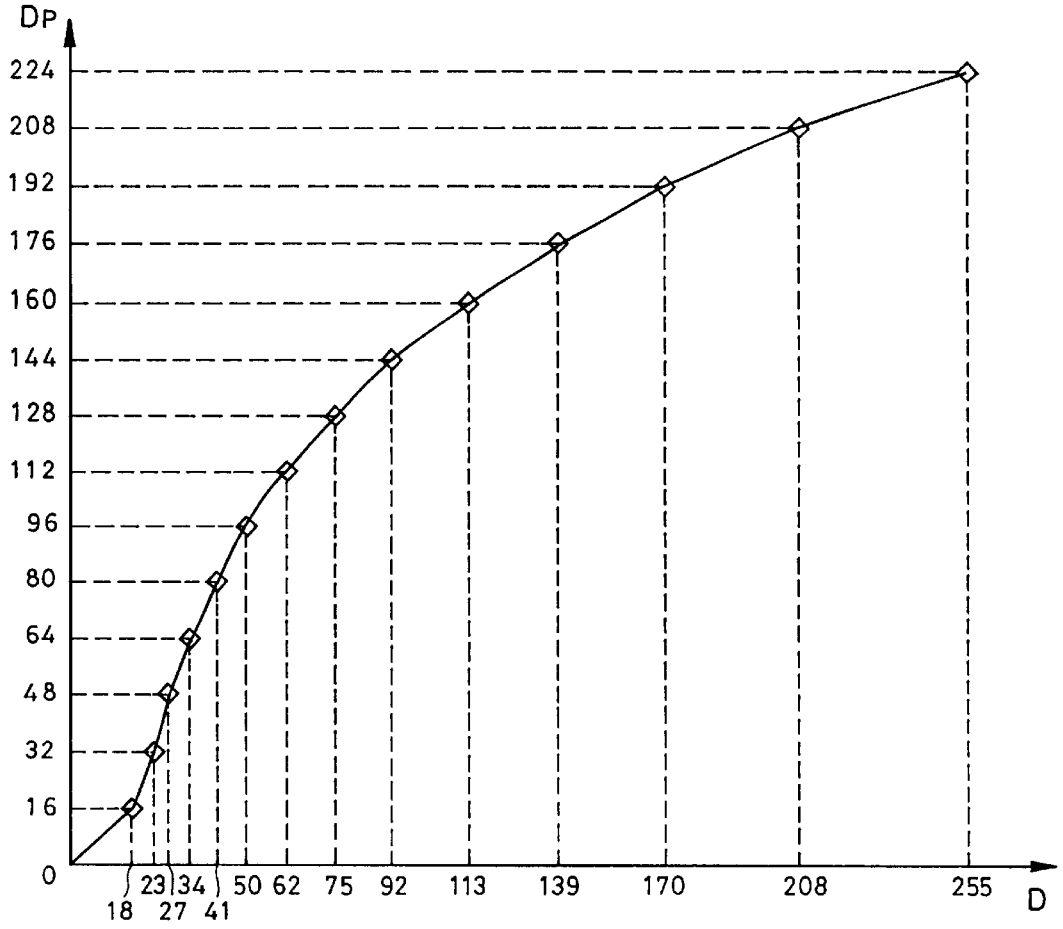
FIG. 4 is a view showing data conversion characteristics of a gray scale correction circuit 32 and a multi-level gray scale pre-stage processing circuit 33.

FIG. 4 is a view showing data conversion characteristics of the gray scale correction circuit 32 and the multi-level gray scale pre-stage processing circuit 33.

The multi-level gray scale processing circuit 34 applies error diffusion processing and dither processing to the 8-bit pixel data Dp supplied from the aforementioned gray scale correction circuit 32, thereby determining multi-level gray scale pixel data Ds that is provided with the number of the bits thereof reduced to 4 bits while maintaining the number of visual brightness levels of halftone to approximately 256 levels of halftone.

In the error diffusion processing, the upper 6 bits are separated from the pixel data Dp as display data and the remaining lower two bits as error data, provided, respectively, with a weighted sum of error data determined based on the pixel data Dp corresponding to respective peripheral pixels to be reflected upon the aforementioned display data. Such an operation allows for expressing the brightness of the lower two bits of an original pixel in a quasi manner with the aforementioned surrounding pixels. Therefore, this makes it possible to express the brightness of a gray scale equivalent to that provided by the aforementioned 8-bit pixel data with display data of the number of bits less than 8 bits, that is, with display data of 6 bits.

In addition, dither processing applies dither processing to 6-bit error diffusion processing pixel data obtained by such error diffusion processing, thereby generating multi-level gray-scale pixel data Ds with the number of bits thereof reduced to 4 bits while maintaining the brightness levels of halftone equivalent to such error diffusion processing pixel data. Moreover, the dither processing is to express one intermediate display level with a plurality of adjacent pixels. For example, consider a case where halftone display equivalent to 8 bits is effectuated by using pixel data of the upper 6 bits of the 8-bit pixel data. In this case, four pixels adjacent to one another on the top and bottom and on the right and left of a pixel are taken as one set, and four dither coefficients a, b, c, and d, which are comprised of coefficient values different from one another, are assigned for addition to respective pixel data corresponding to each of the set of pixels. According to such dither processing, four pixels are to produce a combination of four different intermediate display levels. Therefore, even if the number of bits of pixel data is 6 bits, four times the level of halftones can be made available for expression, that is, an 8-bit equivalent halftone display can be made available.

A drive data generating circuit 35 converts such 4-bit multi-level gray scale pixel data Ds into 8-bit drive pixel data HD in accordance with the conversion table shown in FIG. 5.

The memory 4 of FIG. 1 writes such drive pixel data HD in sequence in accordance with a write signal supplied from the drive control circuit 2. After having completed writing the drive pixel data $HD_{11-nm}$ for one screen (with n rows and m columns), such write action allows the memory 4 to divide the drive pixel data $HD_{11-nm}$ for one screen into each bit digit as follows in accordance with the read signal supplied from the drive control circuit 2. That is, $DB1_{11-nm}$: the first bit of the drive pixel data $HD_{11-nm}$ $DB2_{11-nm}$: the second bit of the drive pixel data $HD_{11-nm}$ $DB3_{11-nm}$: the third bit of the drive pixel data $HD_{11-nm}$ $DB4_{11-nm}$: the fourth bit of the drive pixel data $HD_{11-nm}$ $DB5_{11-nm}$: the fifth bit of the drive pixel data $HD_{11-nm}$ $DB6_{11-nm}$: the sixth bit of the drive pixel data $HD_{11-nm}$ $DB7_{11-nm}$: the seventh bit of the drive pixel data $HD_{11-nm}$ $DB8_{11-nm}$: the eighth bit of the drive pixel data $HD_{11-nm}$ Then, the memory 4 reads the data $DB1_{11-nm}$, $DB2_{11-nm}$, . . . $DB8_{11-nm}$ in sequence line by line and supplies the data to an address driver 6.

Figure 6:
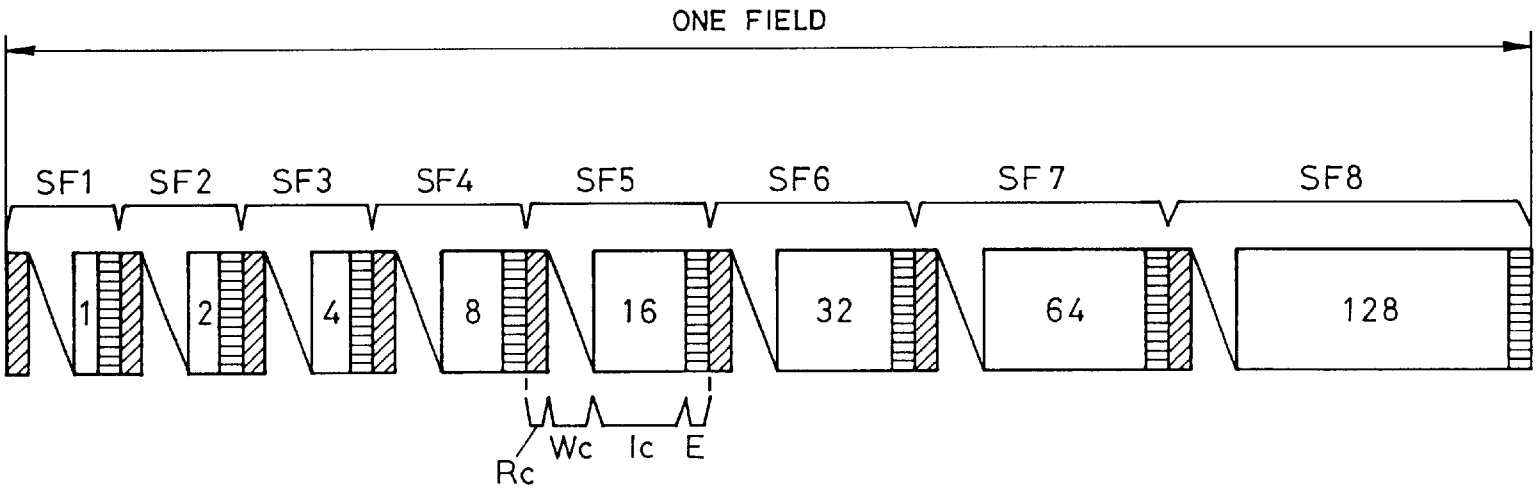
FIG. 6 is a view showing a light emission drive format in the plasma display device shown in FIG. 1.

The drive control circuit 2 supplies various types of timing signals for controllably driving the PDP 10 in accordance with the light-emission drive format shown in FIG. 6 to the address driver 6, the first sustain driver 7, and the second sustain driver 8, respectively.

In the light emission drive format shown in FIG. 6, the display period of one field is divided into 8 sub-fields consisting of sub-fields SF1 through SF8. In each of these sub-fields SF1 through SF8, each of a reset process Rc, a pixel data write process Wc, a light-emission sustain process Ic, and an erase process E is executed.

Figure 7:
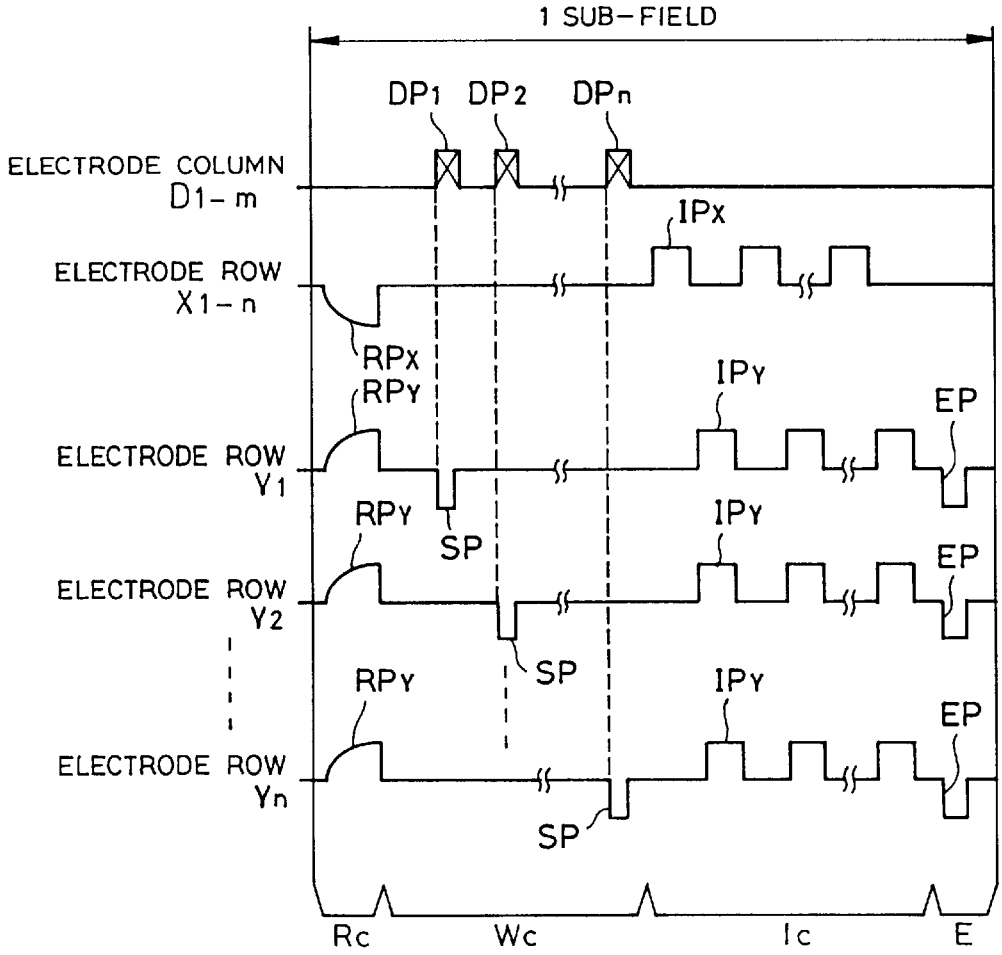
FIG. 7 is a view showing an example of the application timing of various types of drive pulses to be applied to a PDP 10 in the plasma display device shown in FIG. 1.

FIG. 7 is a view showing the application timing (within one sub-field) of various types of drive pulses that each of the address driver 6, the first sustain driver 7, and the second sustain driver 8 applies to the electrode columns and electrode rows of the PDP 10.

First, in the simultaneous reset process Rc to be effectuated at the head of each sub-field, the first sustain driver 7 applies a reset pulse RPx of negative polarity shown in FIG. 7 to the electrode rows $X_1$ through $X_n$ of the PDP 10. At the same time as the application of such reset pulses RPx, the second sustain driver 8 applies a reset pulse RPy of positive polarity to the electrode rows $Y_1$ through $Y_n$. The application of these reset pulses RPx and RPy allows reset discharge to be carried out in all discharge cells of the PDP 10, and thus uniform wall charge of a predetermined quantity is built up in respective discharge cells. This allows all discharge cells to be initialized once to the "light-emitting cells".

In the subsequent pixel data write process Wc, the address driver 6 generates a group of pixel data pulses $DP_1$ through $DP_n$ for each line in accordance with the aforementioned $DB1_{11-nm}$ and then applies the pulses sequentially to the electrode column $D_{1-m}$ line by line. For example, in the pixel data write process Wc of sub-field SF1, a group of pixel data pulses $DP1_1$ through $DP1_n$ are generated in accordance with the aforementioned $DB1_{11-nm}$ and then applied in sequence to the electrode columns $D_1$ through $D_m$ line by line. Moreover, in the pixel data write process Wc of subfield SF8, a group of pixel data pulses $DP8_1$ through $DP8_n$ are generated in accordance with the aforementioned $DP8_{11-nm}$ and then applied in sequence to the electrode columns $D_1$ through $D_m$ line by line. Moreover, the address driver 6 generates high voltage pixel data pulses in cases where the aforementioned DB has a logic level "1", while generating low voltage, pixel data pulses (for example, zero volt) in cases where the aforementioned DB has a logic level "0". Moreover, in such pixel data write process Wc, as shown in FIG. 7, the first sustain driver 7 generates scan pulses SP of negative polarity at the same timing as each application timing of the group of pixel data pulses $DP_1$ through $DP_n$ and applies the pulses in sequence to the electrode rows $Y_1$ through $Y_n$. Here, discharge (selective erase discharge) is produced only in the discharge cells located at the intersections of the "rows" to which the aforementioned scan pulse SP is applied and the "columns" to which a high-voltage pixel data pulse is applied, so that the wall charge remaining within the discharge cells are selectively erased. This selective erase discharge causes the discharge cells that have been reset to the state of a "light-emitting cell" at the aforementioned simultaneous reset process Rc to change to a "non-light-emitting cell". Moreover, the discharge cells that are formed in the "columns" to which the aforementioned high-voltage pixel data pulses are not applied are provided with no discharge, but are sustained to a state of being initialized in the aforementioned simultaneous reset process Rc, that is, to the state of a "light-emitting cell". By such an operation, a "light-emitting cell" in which a light emission state is sustained in the light-emission sustain process, which is to be described later and a "non-light-emitting cell" which remains in a non-light-emitting state are set alternatively in response to pixel data. Thus, the so-called writing of pixel data is carried out.

In the light-emission sustain process Ic, the first sustain driver 7 and the second sustain driver 8 apply sustain pulses $IP_X$ and $IP_Y$ alternately as shown in FIG. 7 to the electrode rows $X_1$ through $X_n$ and $Y_1$ through $Y_n$. Each time such sustain pulses $IP_X$ and $IP_Y$ are applied alternately, discharge cells with a wall charge remaining therein (that is, the discharge cells that have been set to "light-emitting cells" in the aforementioned pixel data write process Wc executed immediately beforehand) repeat sustain discharge accompanying light emission. At this time, the ratio of the frequency by the sustain discharge effectuated in the light-emission sustain process Ic of each of the sub-fields SF1 through SF8 is as follows as shown in FIG. 6. That is,

SF1: 1,

SF2: 2,

SF3: 4,

SF4: 8,

SF5: 16,

SF6: 32,

SF7: 64, and

SF8: 128.

In the erase process E carried out at each last sub-field, the second sustain driver 8 generates an erase pulse EP and then applies the pulse to each of the electrode rows $Y_1$ through $Y_n$. The application of such an erase pulse EP causes erase discharge to be generated in all discharge cells of the PDP 10, so that wall charge remaining in all discharge cells disappears. This causes all discharge cells of the PDP 10 to turn to "non-light-emitting cells".

FIG. 8 is a view showing the correspondence among each of the 15 levels of halftone drive to be performed by the aforementioned drive, the aforementioned pixel data D, Dp, the multi-level gray scale pixel data Ds, the drive pixel data HD, and the light emission drive patterns within one field to be effectuated in accordance with such drive pixel data HD.

Here, in cases where the bit of the drive pixel data HD has a logic level "1", the selective erase discharge is generated in the pixel data write process Wc in a sub-field corresponding to the bit digit and the discharge cell is set to a "non-light-emitting cell". On the other hand, in cases where the bit of the drive pixel data HD has a logic level "1", the selective erase discharge is not generated in the pixel data write process Wc in a sub-field corresponding to the bit digit. Therefore, the discharge cell remains as a "light-emitting cell", and light emission by a sustain discharge is repeatedly executed by the frequency shown in FIG. 6 in the light-emission sustain process Ic of the sub-fields (indicated by white circles).

Thus, according to the first through $15^{th}$ levels of halftone drive shown in FIG. 8, the following 15 levels display brightness. That is,

{0, 1, 2, 3, 4, 5, 7, 11, 18, 27, 43, 67, 105, 164, 256.}

That is, drive corresponding to the brightness of 15 levels of halftone is effected which consists of 0, 1, 2, 3, 4, 5, 7, 11, 18, 27, 43, 67, 105, 164, and 256, out of a brightness of 256 levels of halftone of 0 through 255 which can be expressed by 8-bit pixel data D.

Here, as shown in FIG. 8, the following light emission is effectuated in each of the first through $15^{th}$ levels of halftone drive. That is, The first level of halftone drive: light emission with display brightness "0" for pixel data D, 0 through 17;

The second level of halftone drive: light emission with display brightness "1" for pixel data D, 18 through 22;

The third level of halftone drive: light emission with display brightness "2" for pixel data D, 23 through 26;

The fourth level of halftone drive: light emission with display brightness "3" for pixel data D, 27 through 33;

The fifth level of halftone drive: light emission with display brightness "4" for pixel data D, 34 through 40;

The sixth level of halftone drive: light emission with display brightness "5" for pixel data D, 41 through 49;

The seventh level of halftone drive: light emission with display brightness "7" for pixel data D, 50 through 61;

The eighth level of halftone drive: light emission with display brightness "11" for pixel data D, 62 through 74;

The ninth level of halftone drive: light emission with display brightness "18" for pixel data D, 75 through 91;

The tenth level of halftone drive: light emission with display brightness "27" for pixel data D, 92 through 112;

The eleventh level of halftone drive: light emission with display brightness "43" for pixel data D, 113 through 138;

The twelfth level of halftone drive: light emission with display brightness "67" for pixel data D, 139 through 169;

The thirteenth level of halftone drive: light emission with display brightness "105" for pixel data D, 170 through 207;

The fourteenth level of halftone drive: light emission with display brightness "164" for pixel data D, 208 through 254;

The fifteenth level of halftone drive: light emission with display brightness "256" for pixel data D, 255;

At this time, pixel data, 0 through 255, is assigned a greater number than the number of levels of lower brightness of the aforementioned 15 levels of halftone drive, thereby providing a slighter difference between the levels of gray scale at the time of display of the lower levels of brightness. For example, as shown in FIG. 8, the pixel data D of 48 levels of halftone from 208 through 255, or the high brightness data, is assigned halftone drive of two levels consisting of the $14^{th}$ and $15^{th}$ levels of halftone drive. The difference in brightness between the levels of halftone in the $14^{th}$ and the $15^{th}$ level of halftone drive is "91". On the other hand, the pixel data D of 50 levels of halftone from 0 through 49, or the low brightness data, is assigned halftone drive of six levels consisting of the $1^{st}$ through $6^{th}$ levels of halftone drive. At this time, the difference in brightness between the levels of halftone in each of the $1^{st}$ through the $6^{th}$ levels of halftone drive is "1".

This is developed in consideration of the fact that the resolution of human eyes to a variation in brightness is higher for images displayed with high brightness than those displayed with low brightness.

That is, in the present invention, the number of levels of halftone drive to be assigned to image display with lower brightness is made larger than that assigned to image display with higher brightness, thereby implementing excellent image display suitable for human visual characteristics wherein human eyes have a higher resolution to a variation in brightness at the time of display with lower brightness.

Moreover, the levels of brightness except for the levels of display brightness of {0, 1, 2, 3, 4, 5, 7, 11, 18, 27, 43, 67, 105, 164, 256} obtained by the aforementioned drive of 15 levels are to be obtained by the multi-level gray scale processing circuit 34 shown in FIG. 3. That is, according to the operation of the multi-level gray scale processing circuit 34, the brightness obtained in one discharge cell is limited to the levels of brightness of the aforementioned 15 levels, however, when considering a plurality of discharge cells, other levels of brightness (except for the aforementioned 15 levels of brightness) corresponding to input video signals can be visualized.

Figure 2:
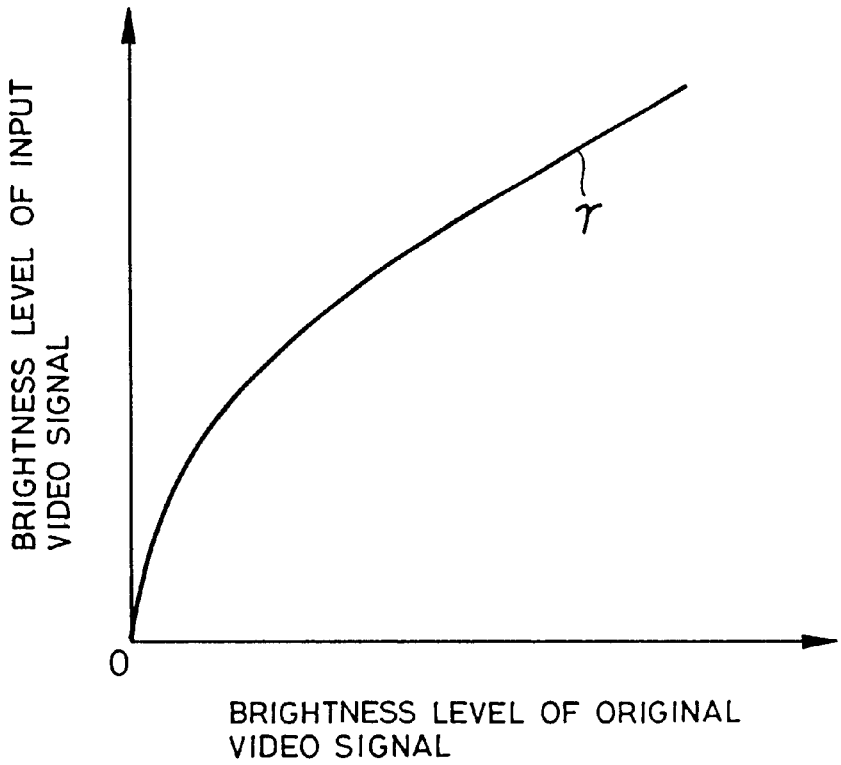
FIG. 2 is a view showing the characteristics of Gamma correction applied to input video signals.

Moreover, the ratio of levels of display brightness provided by the $1^{st}$ through $15^{th}$ halftone drive shown in FIG. 8 shows that the Gamma characteristic applied to input video signals as shown in FIG. 2 is released and shows the inverse Gamma ratio for restoring levels of brightness to those shown by original video signals. That is, in the CRT (Cathode Ray Tube) which expresses the levels of brightness by means of the intensity of a magnetic field excited in phosphor, the phosphor is not magnetized linearly and thus drive is effectuated by using input video signals to which the Gamma correction is applied as shown in FIG. 2. However, in a plasma display panel that expresses brightness by the frequency of light emissions, desired levels of brightness can be obtained with original video signals to which the Gamma correction is not applied. Accordingly, the Gamma correction applied to input video signals as shown in FIG. 2 is released, and the ratio of the frequency of light emissions in respective sub-fields SF1 through SF8 is set to the inverse Gamma ratio in order to perform display in accordance with the brightness levels of original video signals.

Moreover, in the aforementioned embodiment, such a case has been taken as an example in that one field is divided into eight sub-fields for halftone drive and the operation has been explained, however, the number of sub-fields into which a field is divided is not limited to four. Moreover, in the aforementioned embodiment, such an operation has been explained that is applied to a light emission drive format in which the simultaneous reset process Rc, the pixel data write process Wc, the light-emission sustain process Ic, and the erase process E are to be executed respectively in each sub-field, however, no limitation is to be made thereto.

Figure 9:
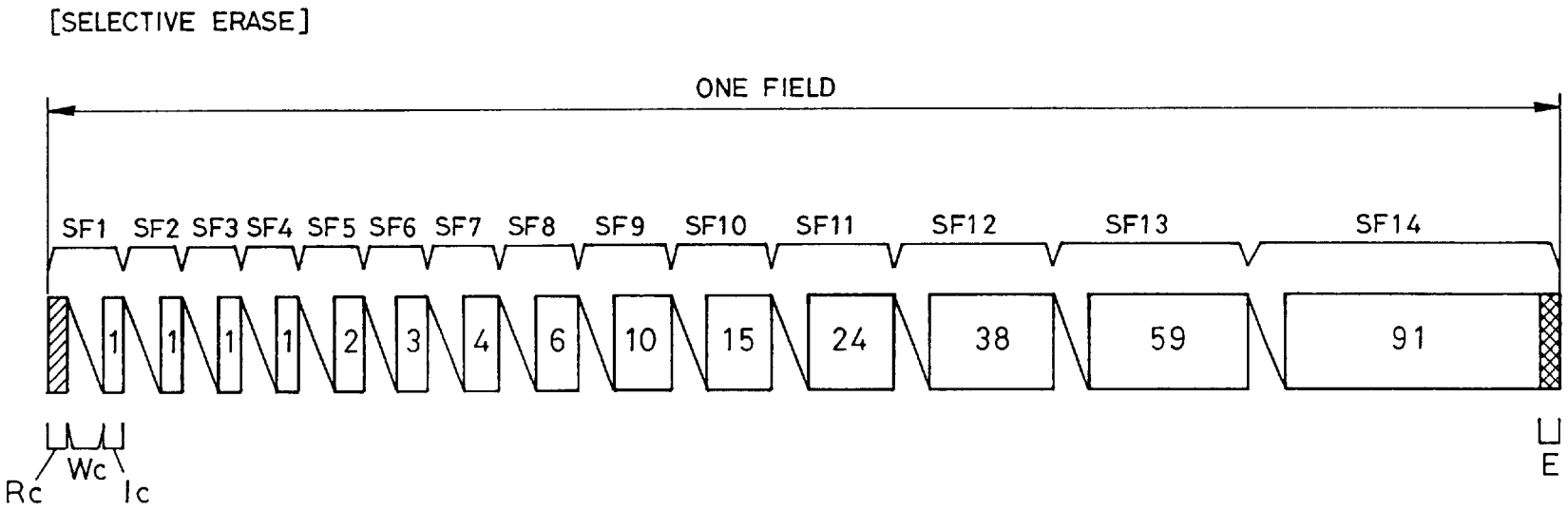
FIG. 9 is a view showing another example of a light emission drive format.

For example, as shown in FIG. 9, the display period of one field may be divided into fourteen sub-fields to be applied to light emission drive formats for performing halftone drive of a PDP. Moreover, in the light emission drive format shown in FIG. 9, the simultaneous reset process Rc is to be executed only in the sub-field SF1, the head sub-field of the display period of one field, and the erase process E is to be executed only in the last sub-field SF14.

Figure 10:
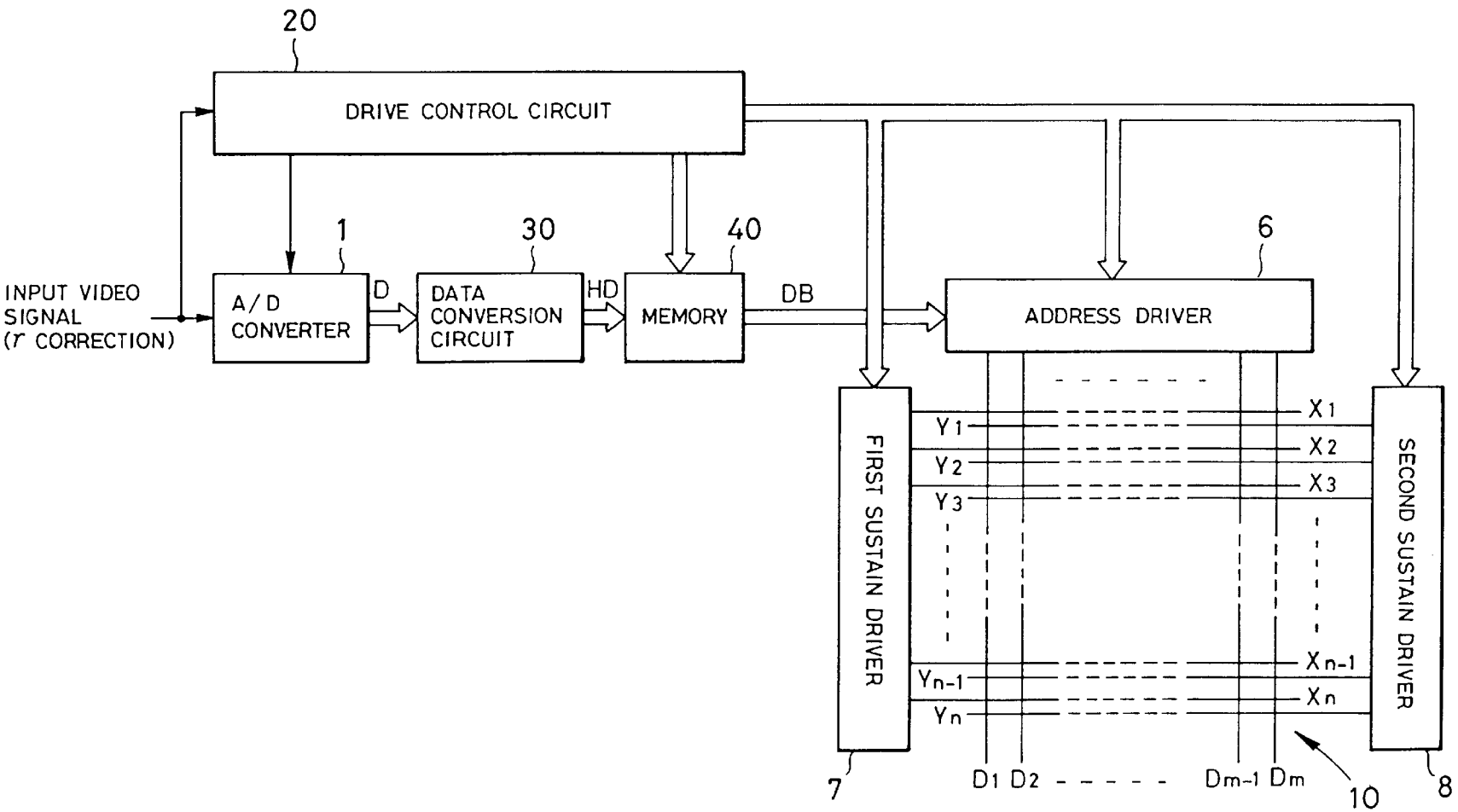
FIG. 10 is a schematic view showing the configuration of a plasma display device which performs light emission drive in accordance with the light emission drive format shown in FIG. 9.

FIG. 10 is a schematic view showing the configuration of a plasma display device which performs light emission drive in accordance with the light emission drive format shown in FIG. 9.

Moreover, in FIG. 10, the operation of the functional modules except for a drive control circuit 20, a data conversion circuit 30, and a memory 4 is the same as that shown in FIG. 1 and thus explanation of these is omitted.

Figure 11:
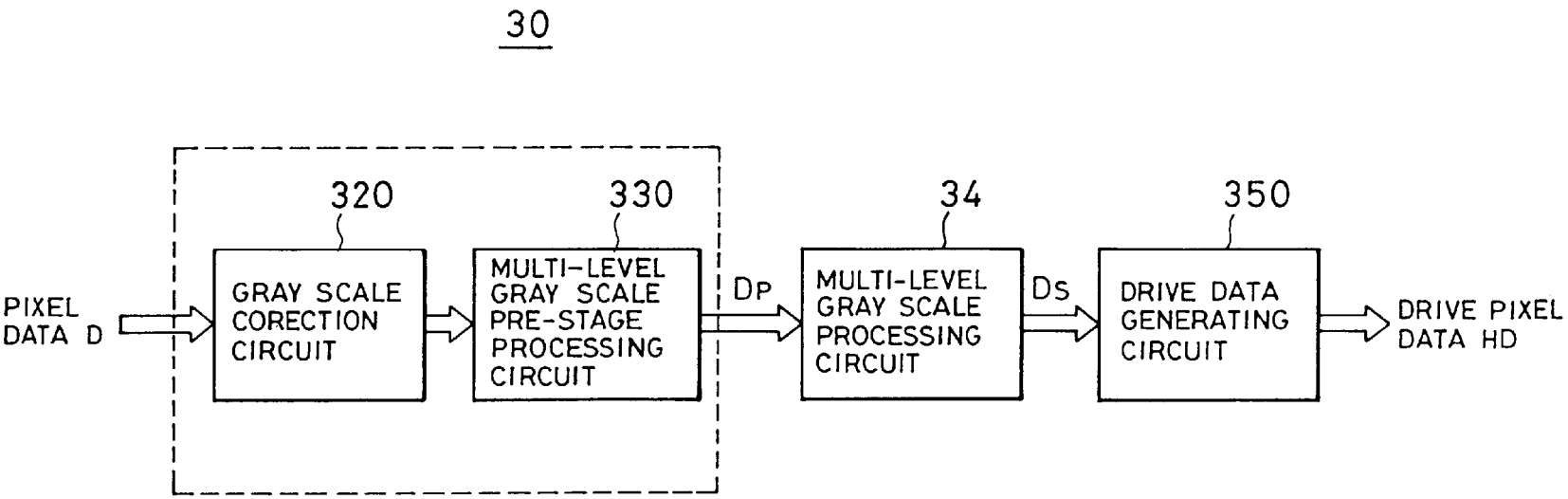
FIG. 11 is a view showing the internal configuration of a data conversion circuit 30.

FIG. 11 is a view showing the internal configuration of such a data conversion circuit 30.

In FIG. 11, a gray scale correction circuit 320 applies data conversion to the pixel data D supplied from the aforementioned A/D converter 1 in order to perform halftone drive for providing display brightness that matches human visual characteristics, and then supplies the resultant data to a multi-level gray scale pre-stage processing circuit 330. Moreover, the action of the gray scale correction circuit 320 is to be described later. The multi-level gray scale pre-stage processing circuit 330 multiplies the pixel data corrected for gray scale by means of the gray scale correction circuit 320, that is, the pixel data that can express the brightness of 256 (0 through 255) levels of halftone with 8 bits by (224/255) to convert the pixel data into 8-bit pixel data Dp of 225 (0 through 224) levels of halftone which is in turn supplied to the multi-level gray scale processing circuit 34. Moreover, this conversion is set in response to the number of bits of input video signals, the number of compression bits provided by multi-level gray scale processing to be described later, and the number of display levels of halftone. As such, the multi-level gray scale pre-stage processing circuit 33 is provided at the preceding stage of the multi-level gray scale processing circuit 34 to be described later to effectuate a conversion to the number of display levels of halftone and the number of compression bits provided by multi-level gray scale processing. This prevents the occurrence of brightness saturation caused by the multi-level gray scale processing and the occurrence of flat portions in display characteristics (that is, the occurrence of gray scale distortion) produced in cases where a display level of halftone is not available at a bit boundary.

Figure 12:
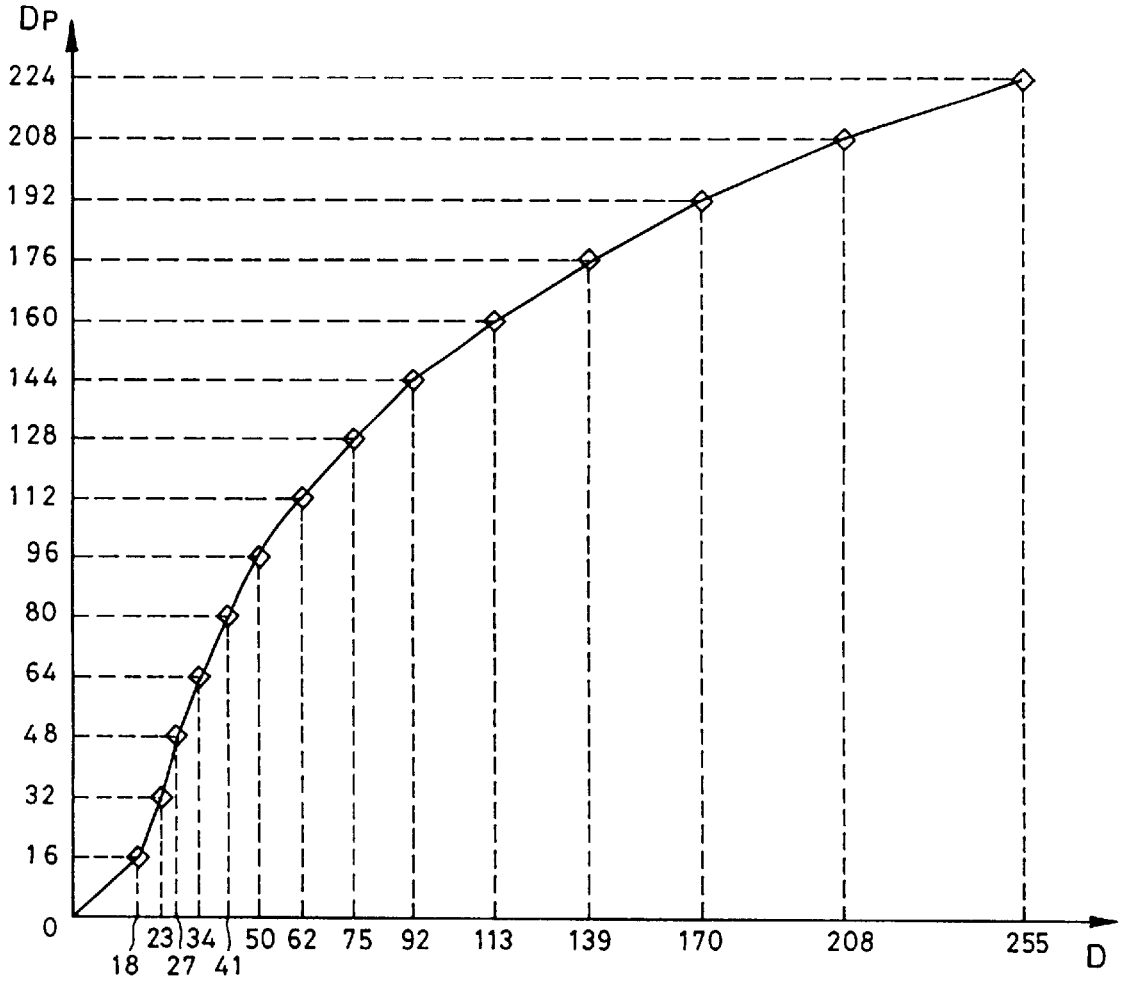
FIG. 12 is a view showing data conversion characteristics of a gray scale correction circuit 320 and the multi-level gray scale pre-stage processing circuit 33.

FIG. 12 is a view showing data conversion characteristics of the gray scale correction circuit 320 and the multi-level gray scale pre-stage processing circuit 330.

The multi-level gray scale processing circuit 34 applies error diffusion processing and dither processing to the 8-bit pixel data Dp supplied from the aforementioned multi-level gray scale pre-stage processing circuit 32, thereby determining the multi-level gray scale pixel data Ds whose number of bits is reduced to four bits while maintaining the number of levels of the visual brightness gray scale to approximately 256 levels of halftone. Moreover, detailed operations of such a multi-level gray scale processing circuit 34 are the same as that mentioned above and thus an explanation is omitted. Moreover, the correspondence among the multi-level gray scale pixel data Ds obtained by the multi-level gray scale processing circuit 34 and the pixel data D and Dp prior to the multi-level gray scale processing is, for example, in the form shown in FIG. 13.

A drive data generating circuit 350 converts the aforementioned 4-bit multi-level gray scale pixel data Ds into the 14-bit drive pixel data HD in accordance with the conversion table shown in FIG. 13 and then supplies the data HD to the memory 40.

The memory 40 of FIG. 10 writes in sequence the aforementioned drive pixel data HD in accordance with write signals supplied from the drive control circuit 20. After such a write operation has completed writing the drive pixel data $HD_{11-nm}$ for one screen (with n rows and m columns), the memory 40 divides the drive pixel data $HD_{11-nm}$ for one screen into each bit digit as follows in accordance with the read signal supplied by the drive control circuit 20. That is, $DB1_{11-nm}$: the first bit of the drive pixel data $HD_{11-nm}$ $DB2_{11-nm}$: the second bit of the drive pixel data $HD_{11-nm}$ $DB3_{11-nm}$: the third bit of the drive pixel data $HD_{11-nm}$ $DB4_{11-nm}$: the fourth bit of the drive pixel data $HD_{11-nm}$ $DB5_{11-nm}$: the fifth bit of the drive pixel data $HD_{11-nm}$ $DB6_{11-nm}$: the sixth bit of the drive pixel data $HD_{11-nm}$ $DB7_{11-nm}$: the seventh bit of the drive pixel data $HD_{11-nm}$ $DB8_{11-nm}$: the eighth bit of the drive pixel data $HD_{11-nm}$ $DB9_{11-nm}$: the ninth bit of the drive pixel data $HD_{11-nm}$ $DB10_{11-nm}$: the tenth bit of the drive pixel data $HD_{11-nm}$ $DB11_{11-nm}$: the eleventh bit of the drive pixel data $HD_{11-nm}$ $DB12_{11-nm}$: the twelfth bit of the drive pixel data $HD_{11-nm}$ $DB13_{11-nm}$: the thirteenth bit of the drive pixel data $HD_{11-nm}$ $DB14_{11-nm}$: the fourteenth bit of the drive pixel data $HD_{11-nm}$ Then, the memory 40 reads each of the data $DB1_{11-nm}$, $DB2_{11-nm}$ . . . $DB14_{11-nm}$ in sequence line by line and supplies the data to the address driver 6.

The drive control circuit 20 supplies various types of timing signals, which are to controllably drive the PDP 10, to the address driver 6, the first sustain driver 7, and the second sustain driver 8 in accordance with the light emission drive format shown in FIG. 9.

Figure 14:
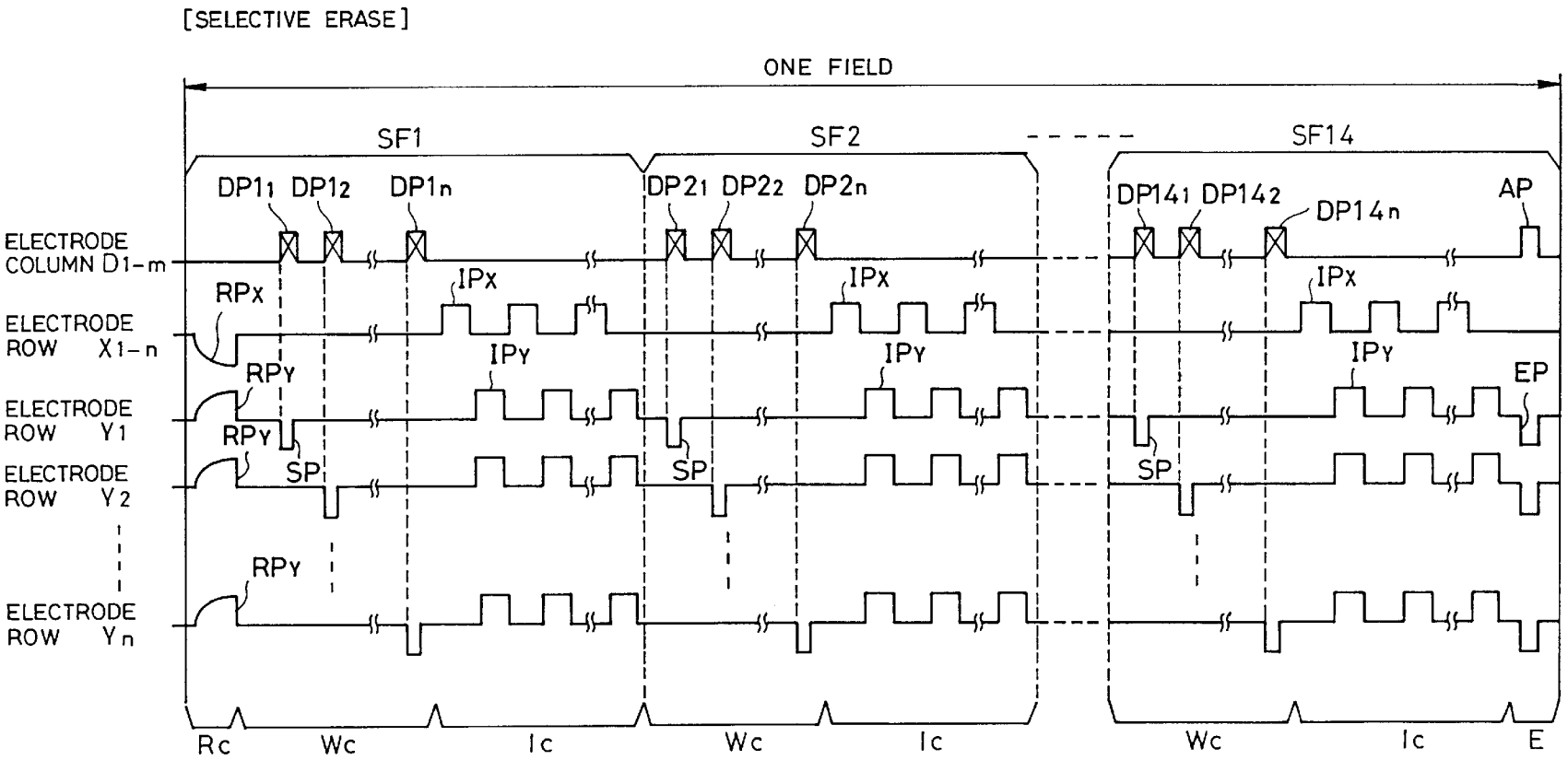
FIG. 14 is a view showing an example of the application timing of various types of drive pulses to be applied to a PDP 10 in the plasma display device shown in FIG. 10.

FIG. 14 is a view showing the application timing of various types of signals for each of the address driver 6, the first sustain driver 7, and the second sustain driver 8 applies to the electrode columns and the electrode rows of the PDP 10 in response to such various types of timing signals.

First, in the simultaneous reset process Rc to be executed only in the head sub-field SF1, the first sustain driver 7 and the second sustain driver 8 apply a reset pulse RPx of negative polarity and a reset pulse RPy of positive polarity, shown in the figure, to the electrode rows $X_1$ through $X_n$ and $Y_1$ through $Y_n$ at the same time. The application of these reset pulses RPx and RPy allows reset discharge to be carried out in all discharge cells of the PDP 10, and thus a predetermined uniform wall charge is built up in respective discharge cells. This allows all discharge cells in the PDP 10 to be initialized once to the "light-emitting cells".

Next, in the pixel data write process Wc of each sub-field, the address driver 6 generates, based on each of $DB1_{11-nm}$ through $DB14_{11-nm}$ supplied from the memory 40 as described above, a group of pixel data pulses $DPl_{11-nm}$ through $DP14_{11-nm}$ having a voltage corresponding to the logic level thereof. The address driver 6 assigns each of the group of pixel data pulses $DP1_{11-nm}$ through $DP14_{11-nm}$ to respective sub-fields SF1 through SF14 as shown in FIG. 14 and then applies the pulses sequentially to the electrode column $D_{1-m}$ line by line at each sub-field.

For example, in the pixel data write process Wc of the sub-field SF1, first, $DB1_{11-1m}$ that corresponds to the first line is extracted from the aforementioned $DB1_{11-nm}$, and then a group of pixel data pulses $DP1_1$ consisting of m pixel data pulses corresponding to the logic level of each of the $DB1_{11-1m}$ and is applied to the electrode columns $D_{1-m}$. Next, $DB1_{21-2m}$ that corresponds to the second line of $DB1_{11-nm}$ is extracted, and then a group of pixel data pulses $DP1_2$ consisting of m pixel data pulses corresponding to the logic level of each of the $DB1_{21-2m}$ and is applied to the electrode columns $D_{1-m}$ Hereafter, in a similar manner, groups of pixel data pulses $DP1_3$ through $DP1_n$ are applied in sequence to the electrode column $D_{1-m}$ line by line. Moreover, the address driver 6 is to generate pixel data pulses of high voltages in cases where the DB1 has, for example, a logic level "1", while generating pixel data pulses of low voltages (zero voltage) in cases where the DB1 has a logic level "0". In addition, in the pixel data write process Wc of the sub-field SF2, $DB2_{11-1m}$ that corresponds to the first line is extracted from the aforementioned $DB2_{11-nm}$, and then a group of pixel data pulses $DP2_1$ consisting of m pixel data pulses corresponding to the logic level of each of the $DB2_{11-1m}$ and is applied to the electrode columns $D_{1-m}$. Next, $DB2_{21-2m}$ that corresponds to the second line of $DB2_{11-nm}$ is extracted, and then a group of pixel data pulses $DP2_2$ consisting of m pixel data pulses corresponding to the logic level of each of a $DB2_{21-2m}$ and is applied to the electrode columns $D_{1-m}$. Hereafter, in the similar manner, groups of pixel data pulses $DP2_3$ through $DP2_n$ are applied in sequence to the electrode column $D_{1-m}$ line by line. In the pixel data write process Wc of each of the sub-fields SF3 to SF14, the address driver 6 also generates groups of pixel data pulses $DP3_{1-n}$ through $DP14_{1-n}$ from each of the $DB3_{11-nm}$ through $DB14_{11-nm}$ and then applies the data pulses in sequence to the electrode column $D_{1-m}$ line by line.

Here, the second sustain driver 8 generates scan pulses SP of negative polarity shown in FIG. 14 at the same time as the application timing of each of the aforementioned groups of pixel data pulses DP. Then, the second sustain driver 8 applies the scan pulses SP in sequence to the electrode rows $Y_1$ through $Y_n$. At this time, discharge (selective erase discharge) is caused only in the discharge cells located at the intersections of the "rows" to which the scan pulse SP is applied and the "columns" to which a high-voltage pixel data pulse is applied, so that the wall charge remaining within the discharge cells are selectively erased. This selective erase discharge causes the discharge cells that have been reset to the state of a "light-emitting cell" at the aforementioned simultaneous reset process Rc to change to the "non-light-emitting cell". Moreover, no discharge is generated in the discharge cells that are formed in the "columns" to which the aforementioned high-voltage pixel data pulses are not applied, but the state of being initialized in the aforementioned simultaneous reset process Rc, that is, the state of a "light-emitting cell" is sustained.

Subsequently, in the light-emission sustain process Ic of each of the sub-fields SF1 through SF14, the first sustain driver 7 and the second sustain driver 8 apply sustain pulses $IP_X$ and $IP_Y$ of positive polarity alternately to the electrode rows $X_1$ through $X_n$ and $Y_1$ through $Y_n$. Moreover, the frequency (period) of the sustain pulses $IP_X$ and $IP_Y$ to be applied in the light-emission sustain process Ic of each of the sub-fields is set to each sub-field. That is, letting the frequency of application in the sub-field SF1 equal to "1", the sustain pulses $IP_X$ and $IP_Y$ are applied for the frequency (period) shown below. That is, SF1: 1,
SF2: 1,
SF3: 1,
SF4: 1,
SF5: 2,
SF6: 3,
SF7: 4,
SF8: 6,
SF9: 10,
SF10: 15,
SF11: 24,
SF12: 38,
SF13: 59, and
SF14: 91.

Such an application of the sustain pulse IP causes the discharge cells in which a wall charge is maintained in the aforementioned pixel data write process Wc, that is, the "light-emitting cells" to perform a sustain discharge every time the cells are applied with the sustain pulses $IP_X$ and $IP_Y$, and to repeat light emissions by the frequency of the discharges.

Finally, in the erase process E of the sub-field SF14 at the last field, the address driver 6 generates an erase pulse AP which is in turn applied to the electrode column $D_{1-m}$. The second sustain driver 8 generates an erase pulse EP at the same time as the application timing of such an erase pulse AP and then applies the erase pulse EP to each of the electrode rows $Y_1$ through $Y_n$. The simultaneous application of these erase pulses AP and EP cause erase discharges to be generated in all discharge cells of the PDP 10, so that the wall charge remaining in all discharge cells disappears. That is, such an erase discharge causes all discharge cells in the PDP 10 to be brought into "non-light-emitting cells".

The plasma display device shown in FIG. 10 executes repeatedly the operation shown in FIG. 14, thereby performing the halftone drive of 15 levels shown in FIG. 13.

That is, only the 15 patterns shown in FIG. 13 are available in the drive pixel data HD that is used in the drive in accordance with FIG. 9 and FIG. 14. Accordingly, this provides all patterns of light emission drive to be performed within the display period of one field with the 15 patterns shown in FIG. 13.

According to the drive pixel data HD shown in FIG. 13, the selective erase discharge is generated (shown by black circles) only in the pixel data write process Wc of any one of sub-fields SF1 through SF14. This causes the wall charge built up in all discharge cells of the PDP 10 in the simultaneous reset process Rc of the head sub-field SF1 to be maintained until the aforementioned selective erase discharge is effectuated. In the light emission sustain process Ic in each of sub-fields SF present during the period, sustain discharges accompanying light emission are generated (shown by white circles).

Therefore, according to the first through $15^{th}$ levels halftone drive shown in FIG. 13, the following display brightness of 15 levels of halftone can be obtained. That is,

{0, 1, 2, 3, 4, 6, 9, 13, 19, 29, 44, 68, 106, 165, 256}.

That is, drive corresponding to the brightness of 15 levels of halftone is effected which consists of 0, 1, 2, 3, 4, 5, 7, 11, 18, 27, 43, 67, 105, 164, and 256, out of a brightness of 256 levels of halftone of 0 through 255 which can be expressed by 8-bit pixel data D.

Here, as shown in FIG. 13, the following light emission is effectuated in each of the first through $15^{th}$ levels of halftone drive. That is, The first level of halftone drive: light emission with display brightness "0" for pixel data D, 0 through 17;
The second level of halftone drive: light emission with display brightness "1" for pixel data D, 18 through 22;
The third level of halftone drive: light emission with display brightness "2" for pixel data D, 23 through 26;
The fourth level of halftone drive: light emission with display brightness "3" for pixel data D, 27 through 33;
The fifth level of halftone drive: light emission with display brightness "4" for pixel data D, 34 through 40;

The sixth level of halftone drive: light emission with display brightness "6" for pixel data D, 41 through 49;

The seventh level of halftone drive: light emission with display brightness "9" for pixel data D, 50 through 61;

The eighth level of halftone drive: light emission with display brightness "13" for pixel data D, 62 through 74;

The ninth level of halftone drive: light emission with display brightness "19" for pixel data D, 75 through 91;

The tenth level of halftone drive: light emission with display brightness "29" for pixel data D, 92 through 112;

The eleventh level of halftone drive: light emission with display brightness "44" for pixel data D, 113 through 138;

The twelfth level of halftone drive: light emission with display brightness "68" for pixel data D, 139 through 169;

The thirteenth level of halftone drive: light emission with display brightness "106" for pixel data D, 170 through 207;

The fourteenth level of halftone drive: light emission with display brightness "165" for pixel data D, 208 through 254;

The fifteenth level of halftone drive: light emission with display brightness "256" for pixel data D, 255;

At this time, pixel data, 0 through 255, is assigned a greater number than the number of levels of lower brightness of the aforementioned 15 levels of halftone drive, thereby providing a slighter difference between levels of gray scale at the time of display of lower levels of brightness.

For example, as shown in FIG. 13, the pixel data D of 48 levels of halftone from 208 through 255, or the high brightness data, is assigned halftone drive of two levels consisting of the $14^{th}$ and $15^{th}$ levels of halftone drive. On the other hand, the pixel data D of 50 levels of halftone from 0 through 49, or the low brightness data, is assigned halftone drive of six levels consisting of the $1^{st}$ through $6^{th}$ levels of halftone drive. Therefore, the difference in brightness between the levels of halftone in the $14^{th}$ and the $15^{th}$ levels of halftone drive for drive with high brightness data is "91", while the difference in brightness between the levels of halftone in each of the $1^{st}$ through the $6^{th}$ levels of halftone drive for drive with low brightness data is "1" or "2". This allows for providing finer expression in response to a variation in the level of halftone at the time of displaying images with low brightness compared with displaying images with high brightness.

As described in the foregoing, in such an embodiment, the number of levels of halftone drive to be assigned to image display with lower brightness is made larger than that assigned to image display with higher brightness, thereby also implementing excellent image display suitable for human visual characteristics whereby human eyes have a higher resolution to a variation in brightness at the time of display with lower brightness.

Moreover, the levels of brightness except for the levels of display brightness obtained by the aforementioned drive of 15 levels are to be obtained by the multi-level gray scale processing circuit 34 shown in FIG. 11. That is, according to the operation of the multi-level gray scale processing circuit 34, the brightness obtained in one discharge cell is limited to the levels of brightness of the aforementioned 15 levels, however, when considering a plurality of discharge cells, other levels of brightness (except for the aforementioned 15 levels of brightness) corresponding to input video signals can be visualized.

Moreover, the ratio of levels of display brightness provided by the $1^{st}$ through $15^{th}$ halftone drives as shown in FIG. 13 show that the Gamma characteristic applied to input video signals as shown in FIG. 2 is released and shows the inverse Gamma ratio for restoring levels of brightness to those shown by original video signals.

Figure 15:
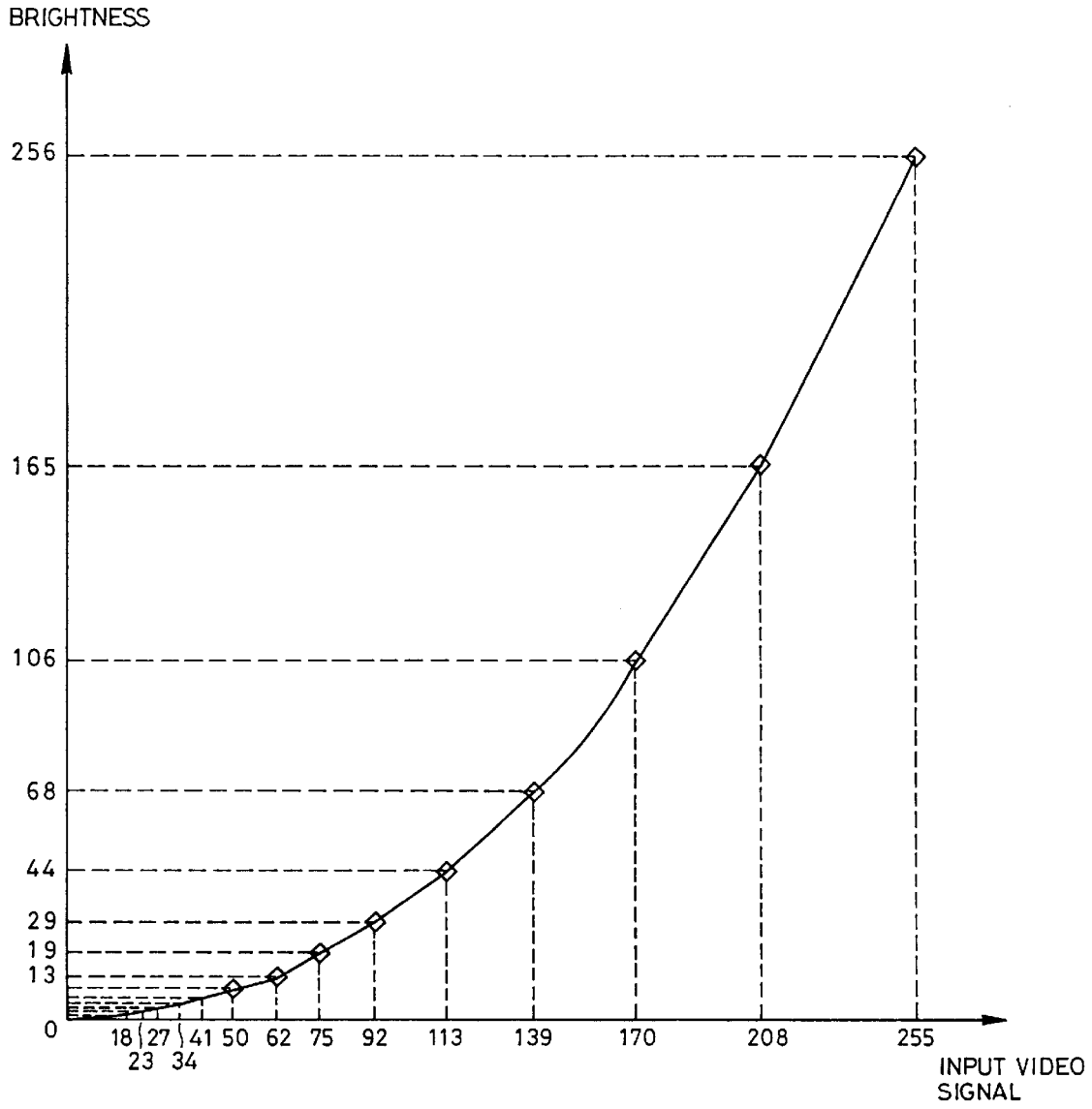
FIG. 15 is a view showing the input-display brightness characteristics according to the halftone drive operation shown in FIG. 13.

FIG. 15 is a view showing the brightness characteristics obtained in response to input video signals according to such halftone drive operations as shown in FIG. 13.

Moreover, the light emission drive pattern used in such a configuration, that is, the light emission drive pattern shown in FIG. 13 is to allow the selective erase discharge to be generated only in any one of the fourteen sub-fields. However, if a small amount of charged particles remain in discharge cells, the selective erase discharge may not be normally generated and thus the wall charge in the discharge cells can not be erased even when the scan pulses SP and pixel data pulses of high voltages are simultaneously applied.

Accordingly, in place of the halftone drive shown in FIG. 13, the halftone drive shown in FIG. 15 may be employed to prevent such accidental light emission operations.

At this time, the marks "*" attached to the drive pixel data HD in FIG. 16 show that the logic level may take on either "1" or "0", while the triangular marks attached to the light emission drive patterns show that the selective erase discharge is generated in cases where the aforementioned mark "*" is equal to logic level "1".

The light emission drive patterns shown in FIG. 16 allow the selective erase discharge to take place sequentially in the pixel data write process Wc of each of two sub-fields successive to each other (shown by black circles). Such an operation allows the second selective erase discharge to extinguish the wall charge normally even when the first selective erase discharge is not able to extinguish normally the wall charge of discharge cells, so that the aforementioned accidental light emission operation can be prevented. Moreover, as shown by triangular marks, in any sub-field after the aforementioned second selective erase discharge has been completed, the third or fourth selective erase discharge may be executed to positively extinguish the wall charge.

Moreover, in the aforementioned embodiment, the operation shown in FIG. 13 has been explained as an example in which the number of levels of halftone drive to be assigned to display images with low brightness is made larger than that assigned to display images with high brightness. However, the format of assignments of the number of levels of halftone drive to pixel data is not limited to those shown in FIG. 13.

Figure 17:
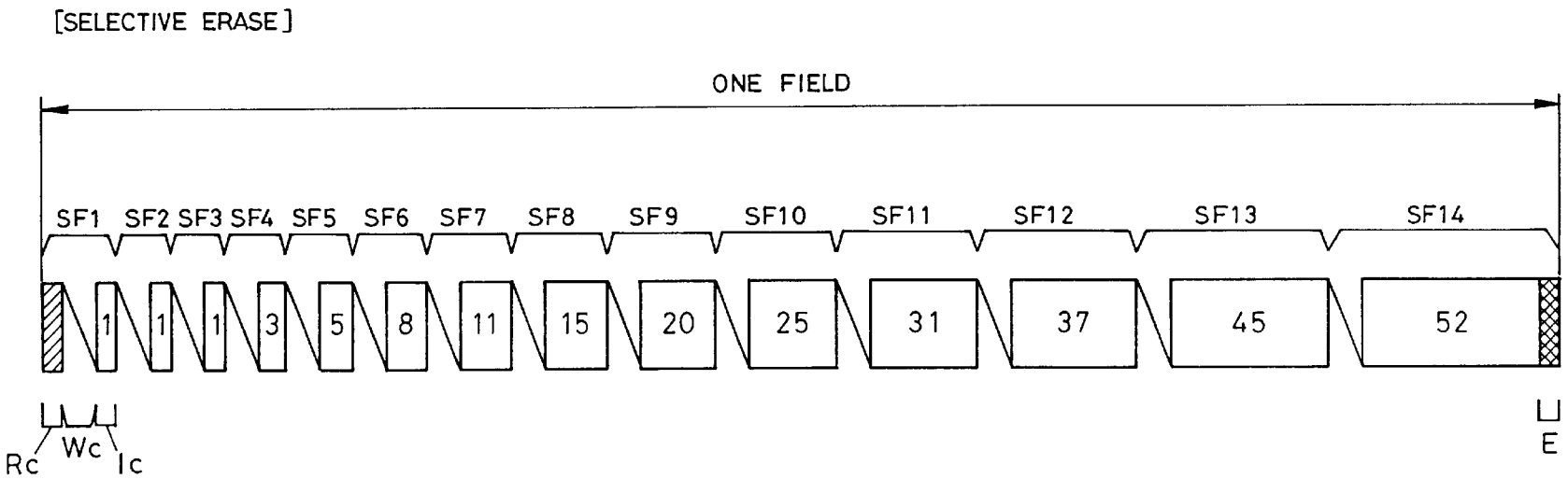
FIG. 17 is a view showing another example of a light emission drive format.
Figure 18:
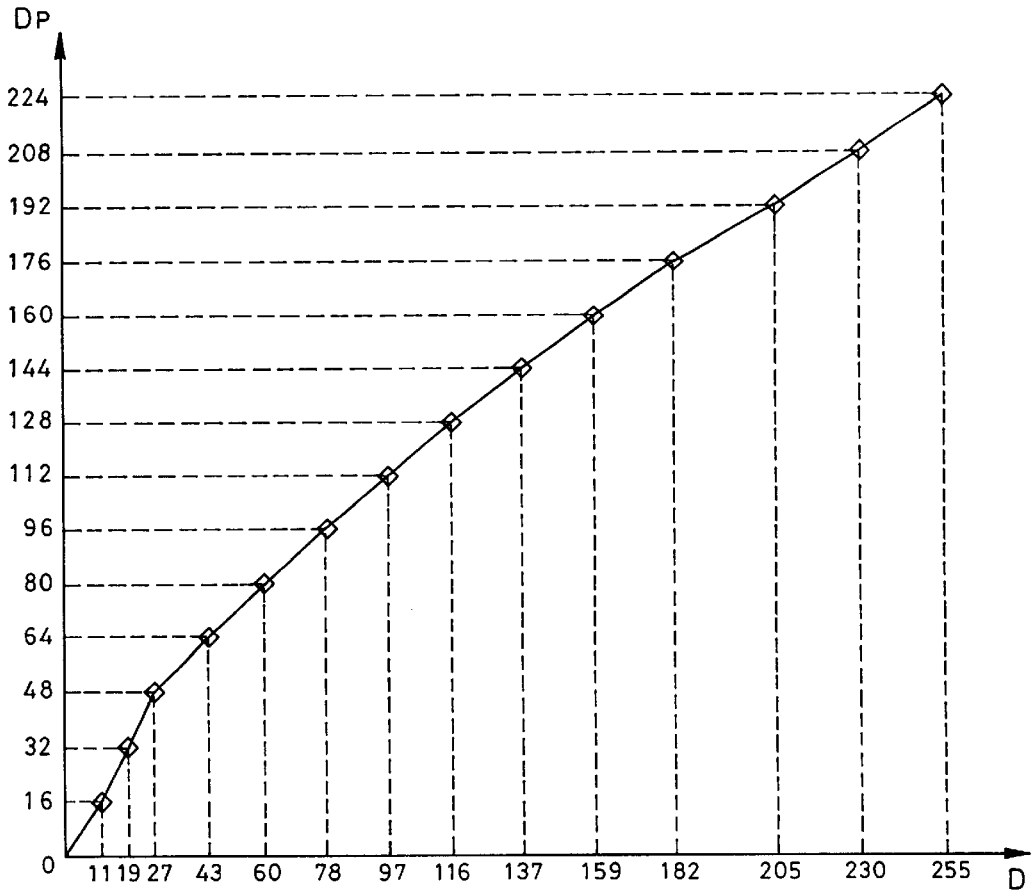
FIG. 18 is a view showing data conversion characteristics of the gray scale correction circuit 320 and the multi-level gray scale pre-stage processing circuit 33 in cases where light emission drive is performed in accordance with the light emission drive format shown in FIG. 17.

FIG. 17 is a view showing another example of a light emission drive format developed in view of such a point. FIG. 18 is a view showing data conversion characteristics of the gray scale correction circuit 320 and the multi-level gray scale pre-stage processing circuit 330 in cases where a light emission drive is performed in accordance with such light emission drive formats.

Moreover, FIG. 19 is a view showing the correspondence among each of the 15 levels of halftone drive to be performed when the operations shown in FIG. 17 and FIG. 18 are employed, pixel data D and Dp, multi-level gray scale pixel data Ds, drive pixel data HD, and the light emission drive pattern in one field.

The following light emission is effectuated in each of the first through $15^{th}$ levels of halftone drive shown in FIG. 19. That is, The first level of halftone drive: light emission with display brightness "0" for pixel data D, 0 through 10;

The second level of halftone drive: light emission with display brightness "1" for pixel data D, 11 through 18;

The third level of halftone drive: light emission with display brightness "2" for pixel data D, 19 through 26;

The fourth level of halftone drive: light emission with display brightness "3" for pixel data D, 27 through 42;

The fifth level of halftone drive: light emission with display brightness "6" for pixel data D, 43 through 59;

The sixth level of halftone drive: light emission with display brightness "11" for pixel data D, 60 through 77;

The seventh level of halftone drive: light emission with display brightness "19" for pixel data D, 78 through 96;

The eighth level of halftone drive: light emission with display brightness "30" for pixel data D, 97 through 115;

The ninth level of halftone drive: light emission with display brightness "46" for pixel data D, 116 through 136;

The tenth level of halftone drive: light emission with display brightness "66" for pixel data D, 137 through 158;

The eleventh level of halftone drive: light emission with display brightness "91" for pixel data D, 159 through 181;

The twelfth level of halftone drive: light emission with display brightness "122" for pixel data D, 182 through 204;

The thirteenth level of halftone drive: light emission with display brightness "159" for pixel data D, 205 through 229;

The fourteenth level of halftone drive: light emission with display brightness "204" for pixel data D, 230 through 254;

The fifteenth level of halftone drive: light emission with display brightness "256" for pixel data D, 255;

In such embodiment, pixel data, 0 through 255, is assigned a greater number than the number of levels of lower brightness of the aforementioned 15 levels of halftone drive, thereby providing a less difference between levels of gray scale at the time of display of lower levels of brightness. However, compared with the halftone drive shown in FIG. 13, pixel data is assigned more in number to a drive with higher brightness of each of the first through $15^{th}$ halftone drives.

For example, in the operation shown in FIG. 19, the pixel: data D of 74 levels of halftone from 182 through 255, or the high brightness data, is assigned halftone drive of four levels consisting of the $12^{th}$ and $15^{th}$ levels of halftone drive. On the other hand, the pixel data D of 78 levels of halftone from 0 through 77, or the low brightness data, is assigned halftone drive of six levels consisting of the $1^{st}$ through $6^{th}$ levels of halftone drive.

Figure 20:
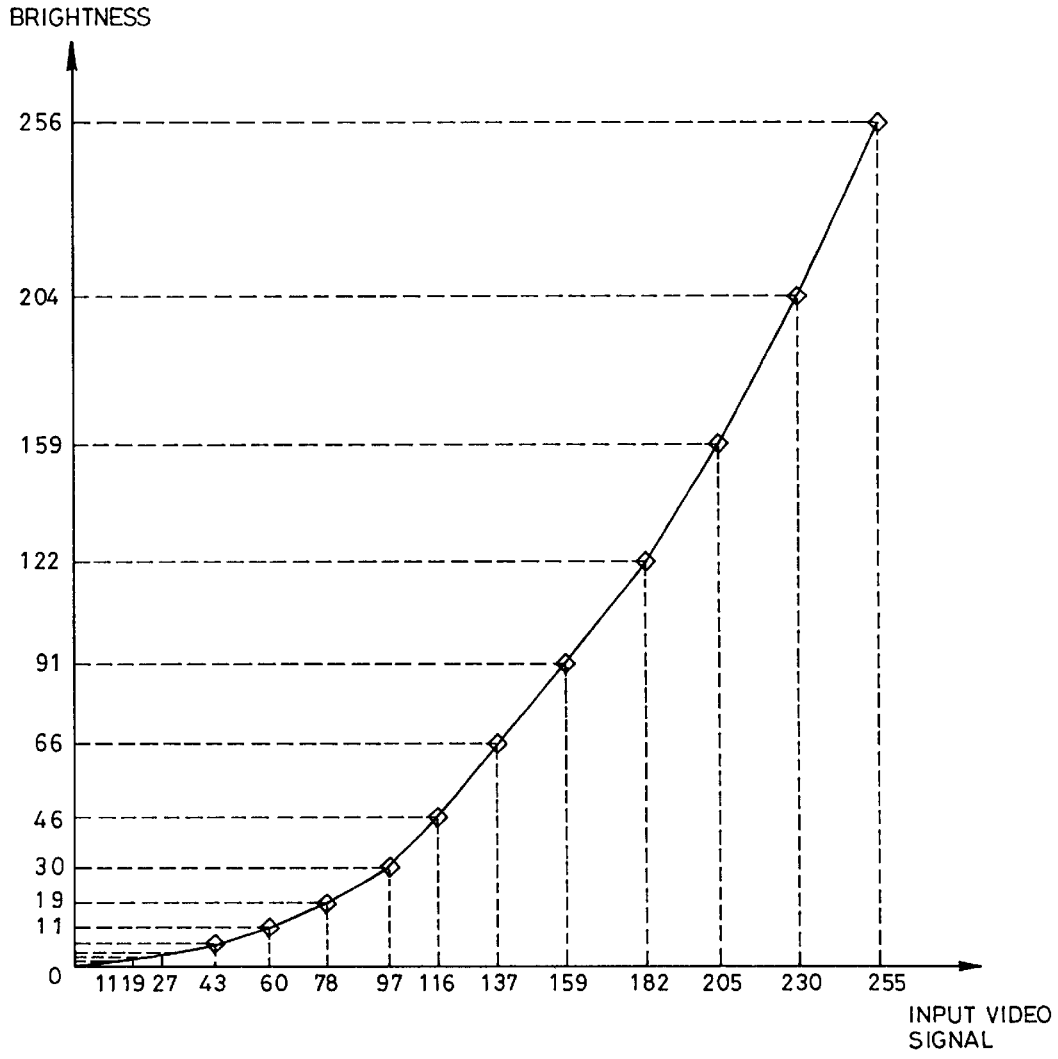
FIG. 20 is a view showing the input-display brightness characteristics according to the halftone drive operation shown in FIG. 19, being a schematic view showing the configuration of the plasma display device which performs light emission drive in accordance with the light emission drive format shown in FIG. 9.

FIG. 20 is a view showing the display brightness characteristics obtained in response to input video signals according to the halftone drive operations described above as shown in FIG. 17 through FIG. 19.

Moreover, in the aforementioned embodiment, the gray scale correction circuit 320 and multi-level gray scale pre-stage processing circuit 330 are allowed to convert pixel data D into pixel data Dp. However, by providing the I/O characteristics of the aforementioned A/D converter 1 with the same characteristics as the data conversion characteristics of the aforementioned gray scale correction circuit 320 and multi-level gray scale pre-stage processing circuit 330, the pixel data Dp may be obtained directly from the A/D converter 1. Furthermore, in the aforementioned embodiment, the ratio of levels of display brightness provided by the first to $15^{th}$ halftone drive is set to the inverse Gamma ratio, thereby releasing the Gamma correction applied to input video signals as shown in FIG. 2. However, the Gamma correction may be released at the stage of pixel data.

Figure 21:
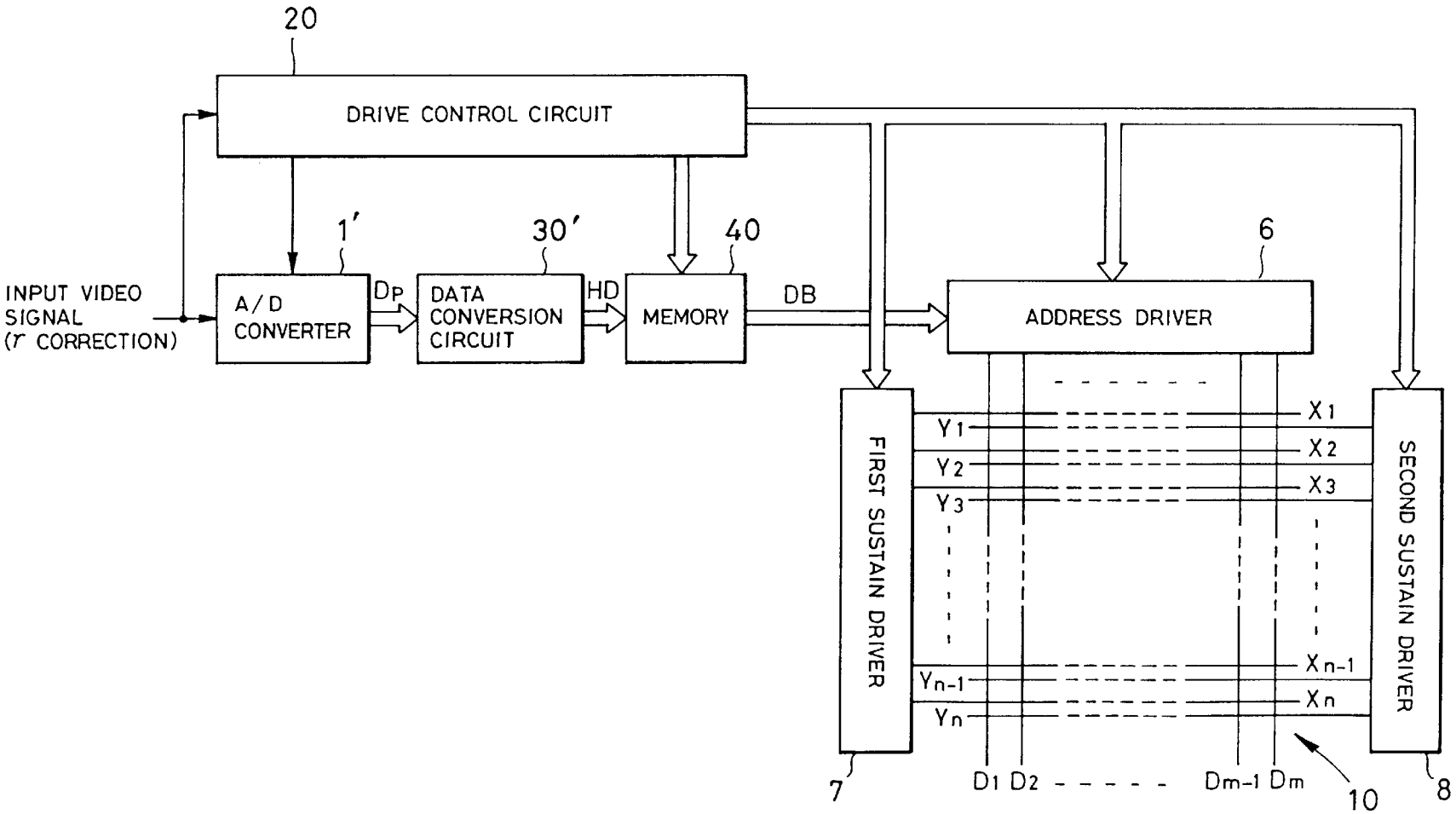
FIG. 21 is a view showing another configuration of a plasma display device.

FIG. 21 is a schematic view showing the configuration of a plasma display device developed in view of these points.

Moreover, in FIG. 21, other components except for the A/D converter 1' and data conversion circuit 30' are the same as those shown in FIG. 10. Accordingly, only the configuration of the A/D converter 1' and the data conversion circuit 30' are to be explained below.

Figure 22:
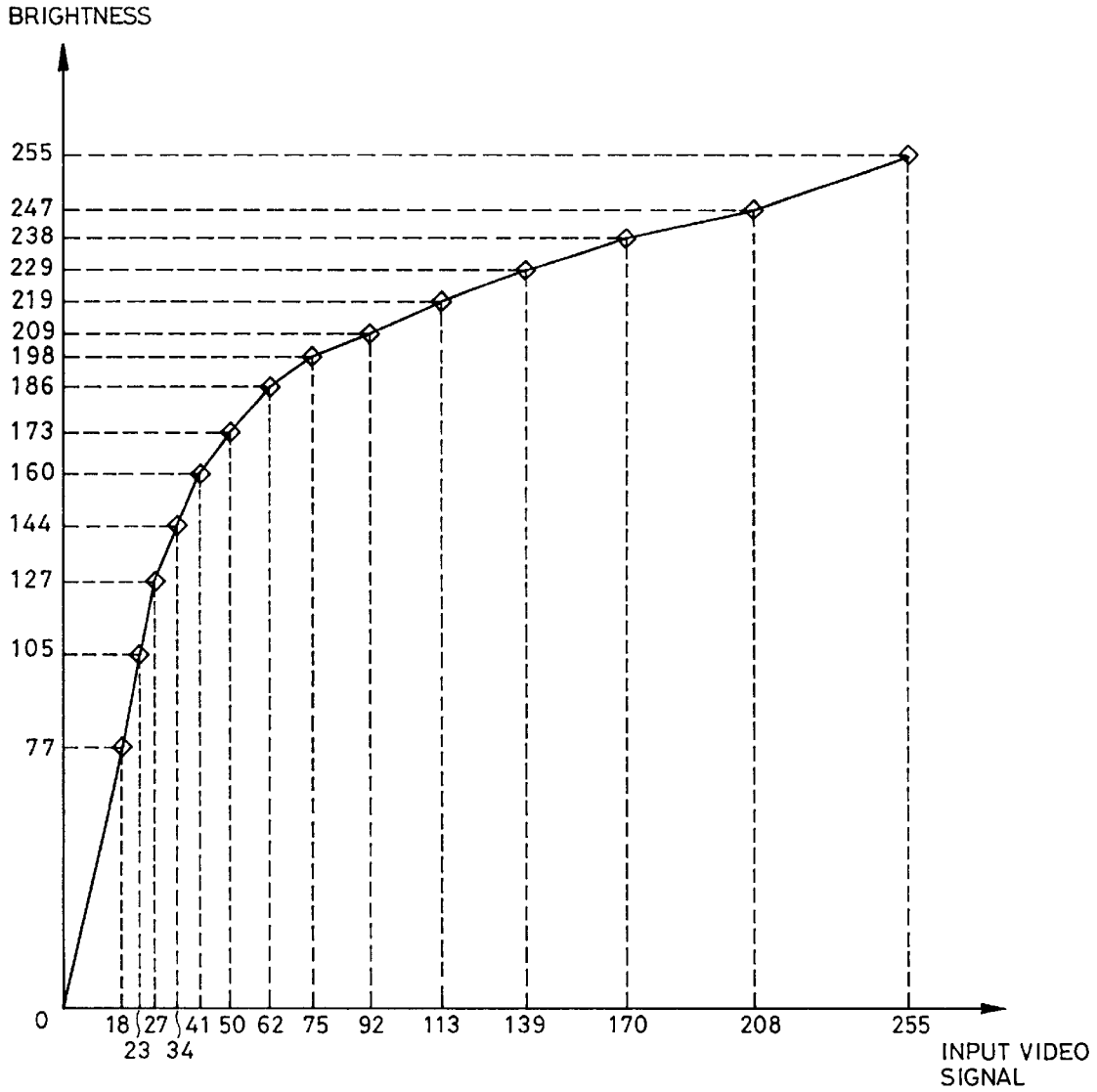
FIG. 22 is a view showing I/O characteristics at the time of A/D conversion by means of an A/D converter 1'.

The A/D converter 1' samples input video signals which are corrected in accordance with the Gamma correction curve ƒÁ shown in FIG. 2 to determine 8-bit pixel data Dp corresponding to each pixel of the PDP 10 and supplies the pixel data Dp to the data conversion circuit 30'. Moreover, the I/O characteristics of the A/D converter 1' are non-linear as shown in FIG. 22.

Figure 23:
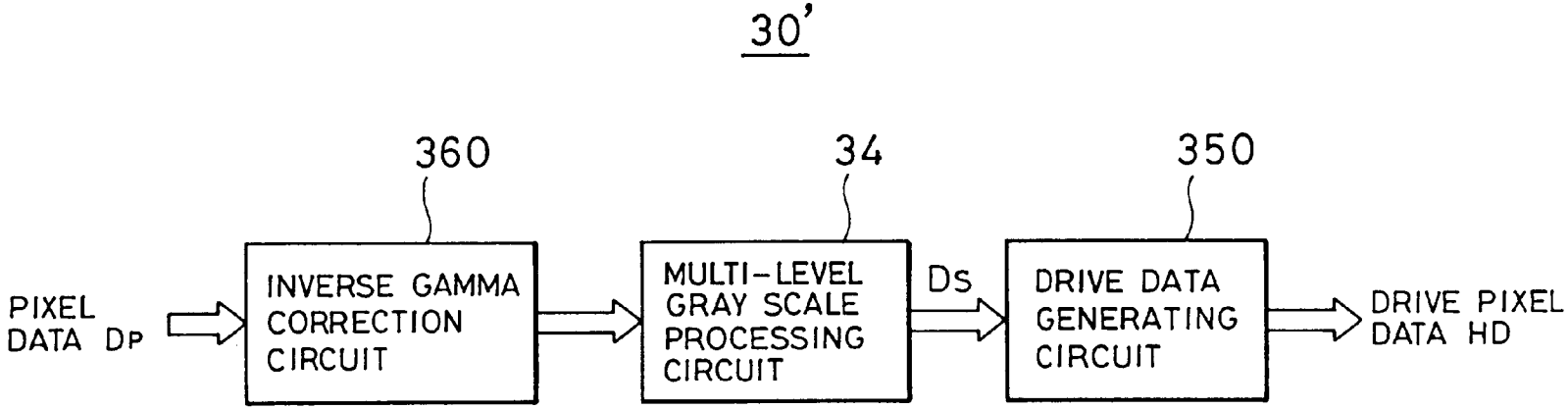
FIG. 23 is a view showing the internal configuration of a data conversion circuit 30'.

FIG. 23 is a view showing the internal configuration of a data conversion circuit 30'.

Figure 24:
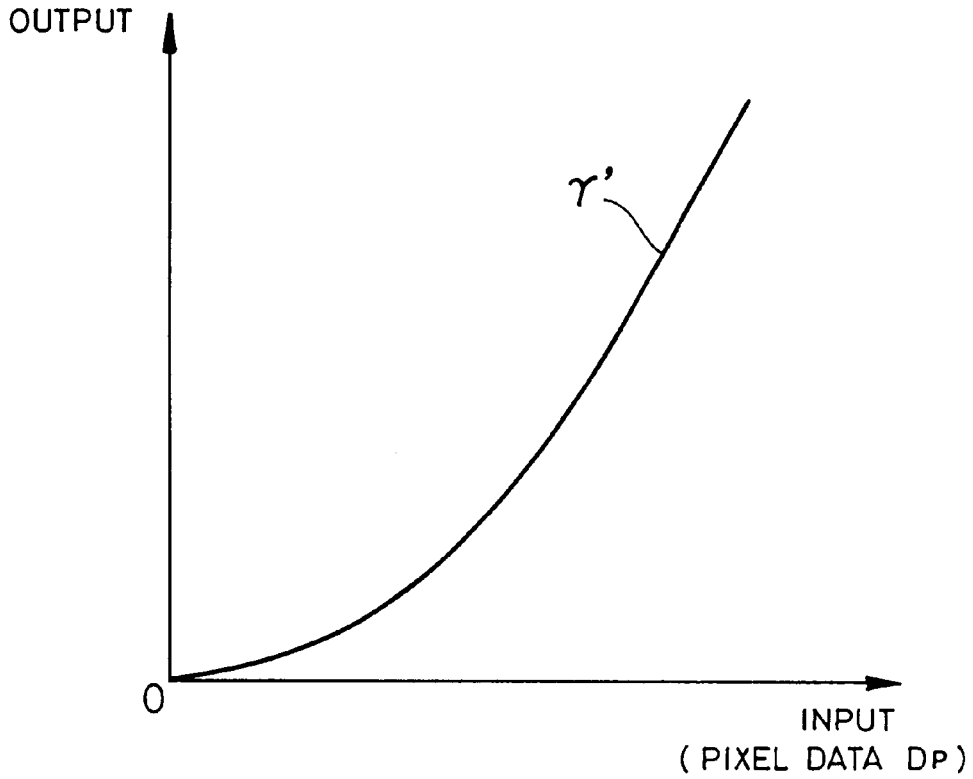
FIG. 24 is a view showing an inverse Gamma correction curveƒÁ' provided by means of an inverse Gamma correction circuit 360.

In FIG. 23, an inverse Gamma correction circuit 360 applies data conversion to the aforementioned pixel data Dp in accordance with the inverse Gamma correction curve ƒ Á' shown in FIG. 24. Then, the inverse Gamma correction circuit 360 thereby determines a pixel data corresponding to an original video signal in which the Gamma correction has come undone and then supplies the data to the multi-level gray scale processing circuit 34. Moreover, the operation of the multi-level gray scale processing circuit 34 and drive data generating circuit 350 is the same as that described above. Accordingly, an explanation of the operation of these functional modules has been omitted.

In addition, in the aforementioned embodiment, a case where the so-called selective erase address method is employed as the write method of pixel data has been explained, in which the selective erase address method allows a wall charge to be built up in each of the discharge cells at the head of one field to set all discharge cells to "light-emitting cells" and allows the wall charge to be selectively erased in response to pixel data to perform writing of pixel data.

However, the present invention may be applied likewise to the case where the so-called selective write address method is employed as the writing method of pixel data, in which a wall charge is to be built up selectively in response to pixel data.

Figure 25:
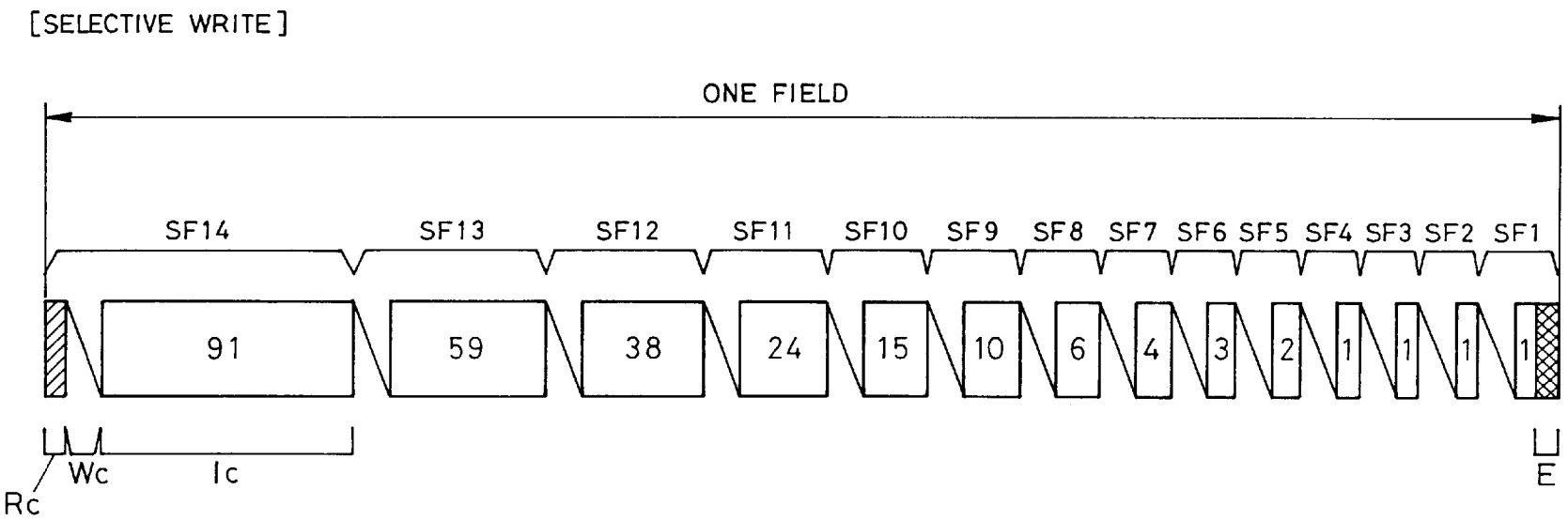
FIG. 25 is a view showing an example of a light emission drive format in a case where a selective write address method is employed.

FIG. 25 is a view showing a light emission drive format in a case where the light emission drive format shown in FIG. 9 is replaced by operations based on the selective write address method. Moreover, FIG. 26 is a view showing the first through $15^{th}$ levels of halftone drive in a case where the light emission drive format shown in FIG. 25 is employed. As such, when the selective write address method is employed, the drive data generating circuit 350 converts the multi-level gray scale pixel data Ds into the drive pixel data HD according to the conversion table as shown in FIG. 26.

Here, in cases where the selective write address method is employed, only in the simultaneous reset process Rc of the head sub-field SF14, the second sustain driver 8 and the first sustain driver 7 apply simultaneously a reset pulse RPx of positive polarity and a reset pulse RPy of negative polarity to the electrode rows Y of the PDP 10. This causes all discharge cells in the PDP 10 to perform reset discharge and each discharge cell to forcibly built up wall charges therein.

Immediately thereafter, the first sustain driver 7 applies simultaneously an erase pulse of negative polarity to the electrode rows $X_1$ through $X_n$ of the PDP 10 to generate an erase discharge, thereby erasing the aforementioned wall charge built up in all discharge cells. That is, in cases where the selective write address method is employed, all discharge cells in the PDP 10 are initialized to a state of "non-light-emitting cells". In each pixel data write process Wc, discharge (selective write discharge) is caused only in the discharge cells located at the intersections of the "rows" to which the scan pulse SP is applied and the "columns" to which a high-voltage pixel data pulse is applied, so that wall charges are selectively built up within the discharge cells. This selective write discharge causes the discharge cells that have been reset to a state of "non-light-emitting cells" at the aforementioned simultaneous reset process Rc to change to "light-emitting cells". Therefore, according to the drive pixel data HD shown in FIG. 26, the selective write discharge is generated only in the sub-fields indicated by black circles to allow each of the subsequent sub-fields following the sub-fields to emit light by the sustain discharge.

As detailed in the foregoing, the method for driving a display panel, according to the present invention, makes the number of levels of halftone drive assigned to display images with low brightness larger than that assigned to display images with high brightness in order to drive the display panel with the number of levels of halftone drive less than the levels of brightness that can be expressed by the pixel data corresponding to input video signals.

Therefore, according to the present invention, it is made possible to implement excellent image display suitable for human visual characteristics wherein human eyes have a higher resolution to a variation in brightness at the time of display of lower brightness than at the time of display of higher brightness.

What is claimed is:

1. A method for driving a display panel in which pixel cells are formed at intersections of a plurality of electrode rows and a plurality of electrode columns arranged so as to intersect said electrode rows, comprising:

performing a gray scale drive of said display panel by assigning each of N gray scale drive patterns for a unit period to input pixel data based on levels of brightness of said input pixel data, wherein each of said N gray scale drive patterns identifies a predetermined unique number of light emissions to be performed within one field period, wherein said levels of said brightness of said input pixel data express M levels of gray scale brightness, wherein M is greater than N, and wherein the number of said gray scale drive patterns assigned to low brightness data of said input pixel data is larger than the number of said gray scale drive patterns assigned to a corresponding amount of high brightness data of said input pixel data.

2. The method for driving a display panel according to claim 1, wherein each of said N gray scale drive patterns comprises a plurality of sub-fields and wherein the method comprises:

executing, within each of said sub-fields, a pixel data write process for setting said pixel cells to either light-emitting cells or non-light-emitting cells in response to said input pixel data, and executing, within each of said subfields, a sustain light-emission process for allowing only said light-emitting cells to emit light a predetermined number of times corresponding to a weight assigned to said sub-field.

3. The method for driving a display panel according to claim 2, comprising the steps of:

providing a reset process for initializing all states of said pixel cells to a state of said light-emitting cells or said non-light-emitting cells only in a head sub-field of said sub-fields, and executing an operation for setting said pixel cells to either one of said light-emitting cells or said non-light-emitting cells only in said pixel data write process in any one of said respective sub-fields.

4. The method for driving a display panel according to claim 2, further comprising the step of providing an erase process for changing all said pixel cells to said non-light-emitting cells only in a last sub-field of said sub-fields.

5. The method for driving a display panel according to claim 3, further comprising the steps of:

in said reset process, initializing all said pixel cells to a state of said light-emitting cells, and in said pixel data write process in any one of said respective sub-fields, setting said pixel cells to a state of said non-light-emitting cells.

6. The method for driving a display panel according to claim 3, further comprising the steps of:

in said reset process, initializing all said pixel cells to a state of said non-light-emitting cells, and in said pixel data write process in any one of said respective sub-fields, setting said pixel cells to a state of said light-emitting cells.

7. The method for driving a display panel according to claim 1, wherein a Gamma correction is applied to said input pixel data, and a distribution of the numbers of light emissions to be effectuated in said N gray scale drive patterns is respectively set to form an inverse Gamma characteristic to compensate for said Gamma correction.

8. The method for driving a display panel according to claim 7, further comprising the step of applying a multi-level gray scale processing to said input pixel data.

9. The method for driving a display panel according to claim 8, wherein said multi-level gray scale processing is error diffusion processing and/or dither processing.

10. The method for driving a display panel according to claim 1, wherein a k-th gray scale drive pattern of said N gray scale drive patterns has r subfields in which light emission is performed, wherein a (k+1)-th gray scale drive pattern of said N gray scale drive patterns has at least (r+1) subfields in which light emission is performed, and wherein k is an integer from 1 to N−1 and r is an integer from 0 to N−1.

11. A method for driving a display device having a pixel, said method comprising:

inputting pixel data representing a particular brightness level, wherein said particular brightness level is one of M available brightness levels, and wherein M is an integer greater than one;

driving said pixel of said display device in accordance with a first drive pattern of N available drive patterns when said particular brightness level is contained in a first brightness level group of some of said M available brightness levels, wherein N is an integer greater than one and less than M; and driving said pixel of said display device in accordance with a second drive pattern of said N available drive patterns when said particular brightness level is contained in a second brightness level group of some of said M available brightness levels, wherein said pixel is brighter when said pixel is driven in accordance with said second drive pattern than when said pixel is driven in accordance with said first drive pattern, and wherein said first brightness level group comprises a different number of said M available brightness levels than said second brightness level group.

12. The method as claimed in claim 11, wherein said M available brightness levels increase in brightness from a first brightness level to an Mth brightness level, wherein said first brightness level group comprises an Ath brightness level to a Bth brightness level of said M available brightness levels, wherein said second brightness level group comprises an Xth brightness level to a Yth brightness level of said M available brightness levels, wherein B is greater than A, X is greater than B, and Y is greater than or equal to X.

13. The method as claimed in claim 12, wherein said first brightness level group comprises a greater number of said M available brightness levels than said second brightness level group.

14. The method as claimed in claim 12, wherein said first brightness level group comprises a smaller number of said M available brightness levels than said second brightness level group.

15. The method as claimed in claim 11, wherein said first brightness level group and said second brightness level group constitute at least a portion of N available brightness level groups respectively corresponding to said N available drive patterns.

16. The method as claimed in claim 12, wherein said first brightness level group and said second brightness level group constitute at least a portion of N available brightness level groups respectively corresponding to said N available drive patterns.

17. A method for driving a display device having a pixel, said method comprising:

inputting pixel data representing a particular brightness level, wherein said particular brightness level is one of M available brightness levels, wherein M is an integer greater than one;

driving said pixel of said display device in accordance with a particular drive pattern of N available drive patterns, wherein N is greater than one and less than M, wherein said M available brightness levels increase in brightness from a first brightness level to an Mth brightness level, wherein said M available brightness levels are divided into N brightness level groups, wherein said N available drive patterns respectively correspond to said N brightness level groups, wherein said particular drive pattern is one of said N available drive patterns corresponding to one of said N brightness level groups containing said particular brightness level, wherein a first brightness level group to an Xth brightness level group of the N brightness level groups contain said first brightness level to an Ath brightness level, wherein an (N−X+1)th brightness level group to said Nth brightness level group contain a Bth brightness level to said Mth brightness level, and wherein X is greater than one, A is greater than one, B is greater than A and less than M, and (M−B) is greater than (A−1).

* * * * *